US012410817B2

(12) United States Patent
Pelletier et al.

(10) Patent No.: US 12,410,817 B2
(45) **Date of Patent: *Sep. 9, 2025**

(54) WATER-COOLED PUMP ASSEMBLY FOR BATHING UNIT SYSTEM AND PUMP ASSEMBLY FOR BATHING UNIT SYSTEM WITH MOUNTING BRACKETS

(71) Applicant: GECKO ALLIANCE GROUP INC., Quebec (CA)

(72) Inventors: Martin Pelletier, Quebec (CA); Benoit Laflamme, Quebec (CA); Philippe Lessard, Quebec (CA)

(73) Assignee: GECKO ALLIANCE GROUP INC., Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/443,909

(22) Filed: Feb. 16, 2024

(65) Prior Publication Data

US 2024/0183362 A1 Jun. 6, 2024

Related U.S. Application Data

(63) Continuation of application No. 17/089,219, filed on Nov. 4, 2020, now Pat. No. 11,959,494.

(51) Int. Cl.
*F04D 29/58* (2006.01)
*F04D 13/06* (2006.01)

(52) U.S. Cl.
CPC ..... *F04D 29/5813* (2013.01); *F04D 13/06* (2013.01); *F04D 29/5806* (2013.01); *F04D 29/5893* (2013.01)

(58) Field of Classification Search
CPC .. F04D 13/06; F04D 29/5806; F04D 29/5813; F04D 29/5893; F04D 29/605–608; F04D 29/628
See application file for complete search history.

(56) References Cited

U.S. PATENT DOCUMENTS 3,653,785 A * 4/1972 Dahlgren ..... F04D 29/586 165/47
5,332,369 A * 7/1994 Jensen ..... F04D 29/5806 417/369

(Continued)

FOREIGN PATENT DOCUMENTS

AU 2006201817 5/2006
AU 2002238279 8/2006

(Continued)

OTHER PUBLICATIONS

Gecko Alliance Group Inc., "TechBook—in.k1000+ full-featured color capacitive touchscreen display keypad for spas", 2019—39 pages.

(Continued)

*Primary Examiner* — Alexander B Comley
(74) *Attorney, Agent, or Firm* — Sheridan Ross P.C.

(57) ABSTRACT

A pump assembly is presented including a motor housing holding a motor, a wet-end housing and a heat transfer interface positioned between a front end of the motor housing and the wet-end housing. The heat transfer interface establishes a first thermal conduction path between the motor housing and the wet-end housing so that a portion of heat generated by the motor is absorbed by the heat transfer interface and a second thermal conduction path between a controller module of the pump assembly and the wet-end housing so that heat generated by the controller module is also absorbed by the heat transfer interface. The pump assembly may include a first and second partial rim members for establishing the first and second thermal conduction paths. Mounting brackets at different radial locations about the motor housing may allow the pump assembly to be mounted in different orientations.

32 Claims, 15 Drawing Sheets

(56) References Cited

U.S. PATENT DOCUMENTS

| | | | | |
|---|---|---|---|---|
| 5,408,708 | A | 4/1995 | Mathis | |
| 5,616,973 | A * | 4/1997 | Khazanov | F04D 29/5806 310/58 |
| 5,667,362 | A * | 9/1997 | Murai | F04D 15/0218 417/44.1 |
| 5,930,852 | A * | 8/1999 | Gravatt | F04D 13/06 4/493 |
| 5,997,261 | A * | 12/1999 | Kershaw | F04D 29/5813 417/357 |
| 6,132,184 | A * | 10/2000 | Robertson | F04D 29/5813 417/366 |
| 6,200,108 | B1 * | 3/2001 | Caudill | F04D 29/5806 165/47 |
| 6,293,769 | B1 * | 9/2001 | Radermacher | H02K 9/227 417/357 |
| 6,655,930 | B2 * | 12/2003 | Sato | F04D 7/02 417/373 |
| 7,347,674 | B2 | 3/2008 | Terry et al. | |
| 8,104,110 | B2 | 1/2012 | Caudill et al. | |
| 8,612,061 | B2 | 12/2013 | Laflamme et al. | |
| 8,644,960 | B2 | 2/2014 | Laflamme et al. | |
| 9,442,639 | B2 | 9/2016 | Laflamme et al. | |
| 9,732,765 | B2 * | 8/2017 | Surowinski | H02K 11/33 |
| 9,822,782 | B2 | 11/2017 | McKinzie | |
| 10,030,670 | B2 | 7/2018 | Bratthall | |
| 10,076,696 | B2 | 9/2018 | Laflamme et al. | |
| 10,219,975 | B2 | 3/2019 | Potucek et al. | |
| 10,235,033 | B2 | 3/2019 | Laflamme et al. | |
| 10,240,604 | B2 | 3/2019 | Stiles, Jr. et al. | |
| 10,323,646 | B2 | 6/2019 | Gell et al. | |
| 10,653,933 | B2 | 5/2020 | Laflamme et al. | |
| 10,907,901 | B2 | 2/2021 | Campbell et al. | |
| 11,959,494 | B2 | 4/2024 | Pelletier et al. | |
| 2002/0114714 | A1 * | 8/2002 | Sato | F04D 7/02 417/373 |
| 2004/0062664 | A1 * | 4/2004 | Weigold | F04D 13/064 417/357 |
| 2005/0164842 | A1 | 7/2005 | Quinn | |
| 2005/0170936 | A1 | 8/2005 | Quinn | |
| 2005/0210575 | A1 | 9/2005 | Erb | |
| 2007/0273222 | A1 | 11/2007 | Morgan et al. | |
| 2008/0282459 | A1 | 11/2008 | Cline et al. | |
| 2009/0056123 | A1 * | 3/2009 | Phillips | F04B 39/14 417/321 |
| 2010/0247352 | A1 * | 9/2010 | Hansen | F04D 29/605 29/888.02 |
| 2011/0023225 | A1 | 2/2011 | Kaykov et al. | |
| 2011/0200469 | A1 * | 8/2011 | Kawabata | F04D 29/5806 417/423.3 |
| 2014/0341752 | A1 | 11/2014 | Gell et al. | |
| 2015/0322966 | A1 * | 11/2015 | Bratthäll | F04D 13/06 417/423.8 |
| 2017/0101992 | A1 * | 4/2017 | Borg | F04D 29/24 |
| 2017/0248143 | A1 | 8/2017 | Gell et al. | |
| 2019/0155494 | A1 | 5/2019 | Laflamme et al. | |
| 2019/0186500 | A1 | 6/2019 | Hohn et al. | |
| 2019/0257319 | A1 * | 8/2019 | Kuronuma | F04D 29/5866 |
| 2020/0248683 | A1 * | 8/2020 | Dietzsch | F04B 45/043 |
| 2020/0309153 | A1 * | 10/2020 | Miller | F04D 29/5813 |
| 2022/0136510 | A1 | 5/2022 | Pelletier et al. | |

FOREIGN PATENT DOCUMENTS

| | | | | |
|---|---|---|---|---|
| CA | 2672409 | | 9/2014 | |
| CA | 2906969 | A1 * | 9/2014 | F04D 13/021 |
| CA | 2904274 | | 3/2017 | |
| CA | 2934395 | | 11/2017 | |
| CA | 2906969 | | 1/2020 | |
| CA | 3098056 | | 11/2022 | |
| DE | 102017214997 | | 2/2019 | |
| DE | 102017214997 | A1 * | 2/2019 | F04D 13/06 |
| DE | 102018125031 | | 4/2020 | |
| DE | 102018125031 | A1 * | 4/2020 | F04D 13/06 |
| EP | 1639984 | | 3/2006 | |
| GB | 2445061 | | 6/2008 | |
| GB | 2466632 | | 7/2010 | |
| GB | 2558328 | | 7/2018 | |
| WO | 02073040 | | 9/2002 | |
| WO | WO-02073040 | A1 * | 9/2002 | F04D 29/20 |
| WO | 2008078121 | | 7/2008 | |
| WO | 2022094688 | | 5/2022 | |

OTHER PUBLICATIONS

International Search Report issued on Jul. 28, 2021 in connection with International Patent Application No. PCT/CA2020/051757—5 pages.

Written Opinion issued on Jul. 28, 2021 in connection with International Patent Application No. PCT/CA2020/051757—8 pages.

International Preliminary Report on Patentability issued on Feb. 16, 2023 in connection with International patent Application No. PCT/CA2020/051757—7 pages.

Examiner's Report issued on Feb. 9, 2022 in connection with Canadian Patent Application No. 3,098,056—4 pages.

Notice of Allowance issued on Aug. 24, 2022 in connection with Canadian Patent Application No. 3,098,056—1 page.

Restriction Requirement issued on Apr. 17, 2023 in connection with U.S. Appl. No. 17/089,219—8 pages.

Examiner's Report issued on May 17, 2023 in connection with Canadien Patent Application No. 3,154,402—4 pages.

Non-Final Office Action issued on Aug. 22, 2023 in connection with U.S. Appl. No. 17/089,219—23 pages.

Notice of Allowance issued on Dec. 15, 2023 in connection with U.S. Appl. No. 17/089,219—3 pages.

European Search Report issued on Sep. 16, 2024 in connexion with European Patent Application No. 20960197.0.—5 Pages.

* cited by examiner

WATER-COOLED PUMP ASSEMBLY FOR BATHING UNIT SYSTEM AND PUMP ASSEMBLY FOR BATHING UNIT SYSTEM WITH MOUNTING BRACKETS

CROSS-REFERENCE TO RELATED APPLICATION

This application is a Continuation of and claims the benefit of priority from U.S. patent application Ser. No. 17/089,219, entitled "Water-cooled pump assembly for bathing unit system and pump assembly for bathing unit system with mounting brackets", filed on Nov. 4, 2020 and which is incorporated by reference herein in its entirety.

TECHNICAL FIELD

The disclosure relates generally to the field of bathing unit systems and, more specifically, to pump assemblies for use in bathing unit systems, such as therapeutic pools, fitness pools, spas, hot tubs, baths and the like.

BACKGROUND

For some time, consumers have enjoyed the recreational and hydro-therapeutic benefits of spas, pools, hot tubs, whirlpools, and jetted baths, generally referred to "bathing unit systems". Bathing unit systems can serve as a retreat for relaxation or socialization. They can also provide therapeutic benefits by making use of circulating heated water to treat muscles and/or joints to improve physical well-being. Swim-in-place bathing unit systems, such as for example swim-in-place pools and spas, are also becoming increasingly popular and allow a swimmer to engage in swimming without the need for a full-sized pool.

Such systems are equipped with water circulation systems that use pump assemblies to circulate water to and from a water receptacle. Such pump assemblies can be used with other components in the bathing unit system to achieve various objectives such as, for example, filtration and heating as well as a broad range of propulsion effects. A pump assembly typically includes a motor for driving a propeller structure that causes water to flow through tubing between a water intake and a water outlet of the pump assembly. While some conventional systems often make use of pump assemblies with constant (single) speed motors, and thereby release a water flow at an essentially constant force when activated, modern systems increasingly allow setting the force (or velocity) of the water released by the pump assemblies to different levels by using pump assemblies equipped with variable speed motors. Such variable speed motors may be continuously variable speed motors or motors configured for achieving distinct discrete motor speeds. Pumps assemblies with variable speed motors are typically equipped with circuit board mounted controllers that are configured to regulate the manner in which the motor operates by controlling an amount of electrical power supplied to the motor.

In a typical pump assembly, the motor and the circuit board mounted controller (when one is present) generate a certain amount of heat that must be dissipated to prevent components of the pump assembly from overheating, which may lead to damage and/or premature ageing of the components. Conventionally, a fan is provided in the pump assembly to dissipate heat generated by the motor and large air-cooled heat sinks are used for cooling the circuit board mounted controller.

There are several deficiencies with heat pump assemblies of the type described above. For example, it is noted that certain bathing unit systems, such as spas, generally have limited space for accommodating devices and one or more pump assemblies must generally fit underneath the spa skirt and share such confined space with other components. The fan to cool the motor and the air-cooled heat sink for the circuit board mounted controller each add significantly to the size and weight of the pump assembly, which is undesirable in a context where space is limited. Another deficiency associated with the use of a fan is the noise that it generates, which can be perceived negatively by the users of the bathing unit. Yet another deficiency associated with a pump assembly of the type described above is that it is lacking in terms of energy-efficiency. For example, in conventional pump assemblies the heat of the motor and circuit board is essentially dissipated into air without otherwise producing any useful output and energy is used to operate the fan for the sole purpose of cooling components.

Some approaches have been proposed to attempt to alleviate some of the above deficiencies.

For example, instead of using a fan to cool the motor, some pump assemblies use a fluid and are equipped with pipes and/or channels that surround an outer surface of the motor housing. As the fluid circulates in the pipes and/or channels, heat from the water is transferred from the motor to the fluid. For examples of fluid-cooled pump assemblies of the types described above, the reader is invited to refer to U.S. Pat. No. 7,347,674 issued Mar. 25, 2008 and to U.S. Pat. No. 6,200,108 issued Mar. 13, 2001. The contents of the aforementioned documents are incorporated herein by reference.

Replacing the fan with a fluid circulating through pipes and/or channels allows reducing some of the noise associated to operating the pump assembly as well as provides an opportunity to reduce the amount of space required for the pump assembly. In addition, in some implementations, the water from the spa may be used as the fluid that is circulated through the pipes or channels, which has an added advantage of recycling the heat absorbed from the motor in the form of heat for the spa water, which improves the energy efficiency of the bathing unit.

While fluid-cooled pumps assemblies of the type described above present some advantages over the conventional fan-cooled assemblies, other deficiencies are associated with such assemblies. One deficiency is that there is a risk that liquid may leak into the motor body as fluid is circulated through the pipes and/or channels over the motor housing, for example through a breach or inadequately sealed joint of the motor housing. To address this, increased care needs to be exercised during manufacturing to ensure that the units are properly sealed, which in turn increases the associated manufacturing costs of the pump assemblies. In addition, the fluid circulated through the pipes or channels may contain corrosive substances, such as for example salts, that may over time corrode the pipes or channels. In addition, particles/debris may be present in the fluid (for example hair or dirt may be present in spa water) and may become lodged in the pipes or channels thereby obstructing the flow of fluid through the pipes and/or channels.

Another challenge associated with bathing unit systems and pump assemblies is related to the limited space. As mentioned above, a pump assembly must generally fit underneath the spa skirt and must share such confined space with other components. To address such space constraints, pump assemblies are typically manufactured in different configurations, each with a water intake and a water outlet positioned in different orientations. A particular pump assembly is selected by a bathing unit manufacturer in part by taking into account the orientation of its intake and outlet. To meet their needs, manufacturers must often keep in inventory multiple types of pump motors having intake and outlet oriented in different manners.

In order to avoid storing pump motors having water intakes and outlets oriented in different manners, some pump assemblies are configured so that the front end (the wet end) of the pump assembly can be disassembled from the back end (the dry end or motor end) of the pump assembly. For such pump assemblies, to change the orientation of the intake and outlet, the pump assembly typically needs to be manually disassembled, usually by unscrewing the front end (the wet end) of the pump assembly. The front end is then rotated relative to the body of the pump assembly and re-fastened to it. A deficiency with such an approach is that the water seal between the front end and the motor can be damaged during these manipulations and it requires more time from technicians performing the disassembling and reassembling of the pump.

Against the background described above, there remains a need in the industry to provide a pump assembly that alleviates at least part the deficiencies associated with existing pump assemblies.

SUMMARY

In accordance with a first aspect, a pump assembly for a bathing unit system is provided, the pump assembly comprising:

a. a motor housing holding an electric motor, the motor housing having a front end, a back end and a rotor shaft extending through the front end;

b. a wet-end housing having:

i. an impeller connected to the rotor shaft extending through the front end of the motor housing thereby allowing the impeller to be rotatable by the electric motor via the rotor shaft;

ii. a water inlet port and a water outlet port in fluid communication with the water inlet port for circulating water through the wet-end housing in response to rotation of the impeller;

and c. a heat transfer interface positioned between the front end of the motor housing and the wet-end housing, wherein the heat transfer interface is configured for establishing a thermal conduction path between the motor housing and the wet-end housing so that, in use, a portion of heat generated by the motor is absorbed by the heat transfer interface and is dissipated in water circulating through the wet-end housing.

Advantageously, embodiments of the above-proposed pump assembly leverage the temperature differential between the water in the bathing unit system and the motor to transfer heat from the pump motor to the water flowing through the pump. As a result, heat dissipated from the motor may be put to use in heating water in the bathing unit rather than being dissipated into the air, thereby leading to improved energy efficiency of the bathing unit system. In addition in pump assemblies of the type described above, through the use of heat transfer interface positioned between the front end of the motor housing and the wet-end housing, the water flow may be essentially limited to the wet-end housing of the pump assembly. This allows concurrently allowing heat to be transferred from the pump motor to the water flowing through the pump while reducing risks of water infiltrating into the motor body relative to systems in which piping surrounding the motor housing.

In some implementations, the heat transfer interface may be engaged with the front end of the motor housing to establish the thermal conduction path between the motor housing and the wet-end housing. The heat transfer interface may include a first surface engaged with the front end of the motor housing and a second surface opposed to the first surface, wherein when the pump assembly is in use, at least a portion of the second surface is exposed to water flowing through the wet-end housing.

In some implementations, the wet-end housing may further include an active heating element powered by a source of electrical power and configured for selectively actively heating water flowing through the wet-end housing. The active heating element may be made using different technologies such as, but without being limited to thick film, a tubular heating element and ceramic heating element.

In some practical implementations, the heat transfer interface may be coupled to the front end of the motor at least in part via an induction heat shrinking process, via a welding process, via a brazing process, through the use of an adhesive and/or using one or more mechanical fasteners, such as but not limiting to clamps, screws and the like.

In practical implementations, the motor housing may be made of a material comprised at least in part of aluminum.

In specific implementations, the heat transfer interface may be made of different types of materials. In some implementations, the heat transfer interface may be made of a thermally conductive material, such as but not limited to, a material that includes copper and/or aluminum. While such materials can provide useful thermal conduction properties, since the heat transfer interface is in contact with water from the bathing unit, and since such water may contain corrosive materials (such as salts), the heat transfer interface may need to be replaced more frequently due to wear.

In alternative implementations, the heat transfer interface may be made of a material generally resistant to corrosion even if heat conduction properties may be lower than materials such as copper and/or aluminum. For example, materials may include, without being limited to, titanium and/or stainless steel. While such materials are not considered to have good thermal conduction properties, it has been found that their respective levels of conduction can be sufficiently suitable to establish a thermal conduction path between the motor housing and the wet-end housing. In addition, materials such a stainless steel and titanium are generally resistant to corrosion and thus, since the heat transfer interface is at least partially in contact with water containing corrosive materials, the use of such materials may extend the useful life of the pump assembly and/or may reduce the frequency of required repairs and maintenance.

In some practical implementations, a thermal interface material may fill at least some voids between the first surface of the heat transfer interface and the front end of the motor housing, wherein the thermal interface material is characterized by a higher thermal conductivity than air, thereby improving the thermal conductivity between the motor housing, the heat transfer interface and the front end of the motor housing. Various types of suitable thermal interface materials may be used to improve the thermal conductivity. For example, the thermal interface material may include a thermal gap filler material, including but not limited to a thermal paste or thermal pad.

In some implementations, the thermal conduction path established by the heat transfer interface between the motor housing and the wet-end housing is a first thermal conductive path. The pump assembly may comprise a controller module for controlling the operation of the electrical motor and the heat transfer interface may be further configured to establish a second thermal conduction path between the controller module and the wet-end housing so that, in use, a portion of heat generated by the controller module is absorbed by the heat transfer interface and is dissipated in water circulating through the wet-end housing. In some implementations, a thermal insulation layer may be located between the controller module and the motor housing to reduce an amount of heat transfer between the controller module and the motor housing. The thermal insulation layer may comprise one or more air gaps between the controller module and the motor housing and/or it may comprise a thermal insulating material between the controller module and the motor housing. Specific examples of suitable thermal insulating material may include, but are not limited to, plastic, Kevlar™, mylar, fiberglass are good insulation materials.

In some implementations, the motor housing may comprise a flange member forming a rim about the front end of the motor housing, the heat transfer interface being configured to engage the flange member. The rim formed by the flange member may include a first partial rim member and a second partial rim member distinct from the first partial rim member. In some implantations, the first partial rim member cooperates with the heat transfer interface to establish the first thermal conduction path between the motor housing and the wet-end housing and the second partial rim member cooperates with the heat transfer interface to establish the second thermal conduction path between the controller module and the wet-end housing, wherein the second partial rim member at least partially thermally insulates the controller module from the motor housing.

The second partial rim member may include a thermal insulation layer positioned between the controller module and the motor housing for at least partially thermally insulating the controller module from the motor housing. In addition, or alternatively, the second partial rim member may include a heat sink portion, the heat sink portion being configured to establish a thermal coupling with the controller module. More specifically, the heat sink portion may comprise a controller-facing side configured to establish the thermal coupling with the controller module, and a motor-housing-facing side shaped to conform to an outer surface of the motor housing.

In some specific implementation, the pump assembly includes components to facilitate mounting the pump assembly to a supporting structure. In this regard, the pump assembly may comprise an external casing having:

a first pump mounting bracket for fastening the pump assembly to a surface mounting bracket, the first pump mounting bracket being positioned at a first radial location on the external casing; and a second pump mounting bracket for fastening the pump assembly to the surface mounting bracket, the second pump mounting bracket being positioned at a second radial location on the external casing, the first radial location being distinct from the second radial location there by permitting the pump assembly to be fastened to the surface mounting at two different angles corresponding to the first radial location and second radial location.

In accordance with another aspect, a pump assembly for a bathing unit system is provided, the pump assembly comprising:

an external casing having an outer surface and a central axis, said external casing including at least two pump mounting brackets protruding from the outer surface of the external casing, wherein a first one of said at least two pump mounting brackets is positioned at a first radial location on the external casing and a second one of said at least two pump mounting brackets is positioned at a second radial location on the external casing; and a surface mounting bracket configured to be mounted to a supporting structure in the bathing unit system;

wherein the surface mounting bracket is configured to engage a selected one of the at least two pump mounting brackets thereby positioning the pump assembly at an angle corresponding to one of the first radial location and second radial location, the selected one of the at least two pump mounting brackets being selected by rotating the external casing about the central axis relative to the to surface mounting bracket to align the selected one of the at least two pump mounting brackets with the surface mounting bracket.

Advantageously, embodiments of the above-proposed pump may allow for conveniently adjusting the radial orientation of the pump assembly without compromising the integrity of the pump assembly by disassembling components of the assembly.

In some practical implementations, the first pump mounting bracket is configured to be fastened to the surface mounting bracket using one or more mechanical fasteners, the one or more mechanical fasteners engaging the first pump mounting bracket and the surface mounting bracket along an axis that extend longitudinally along at least part of the supporting structure. Such configuration facilitates the installation of the pump assembly by positioning the fasteners in a manner that renders them accessible by a technician and reduces their interference with the external casing.

In accordance with another aspect, a pump assembly is provided for a bathing unit system, the pump assembly comprising:

a. a motor housing holding an electric motor, the motor housing having a front end and a back end;

b. a wet-end housing positioned adjacent the front end of the motor housing, the wet-end housing having a water inlet port and a water outlet port in fluid communication with the water inlet port for circulating water through the wet-end housing;

c. controller module including a circuit board mounting controller for controlling the operation of the electrical motor; and d. a heat transfer interface positioned between the controller module and the wet-end housing, wherein the heat transfer interface is configured for establishing a thermal conduction path between the controller module and the wet-end housing so that, in use, a portion of heat generated by the controller module is absorbed by the heat transfer interface and is dissipated in water circulating through the wet-end housing.

Advantageously, embodiments of the above-proposed pump assembly leverage the temperature differential between the water in the bathing unit system and the controller module to transfer heat from the controller module to the water flowing through the pump. As a result, heat dissipated from the controller module may be put to use in heating water in the bathing unit rather than being dissipated into the air, thereby leading to improved energy efficiency of the bathing unit system. In addition, this configuration may allow reducing the overall size of the pump assembly by replacing what would typically be relatively large fin-based heat sinks with a more compact configuration using a heat transfer interface and water flow.

In some implementations, the pump assembly includes a thermal insulation layer located between the controller module and the motor housing to reduce an amount of heat transfer between the controller module and the motor housing. Different types of the thermal insulation layers may be considered in practical implementations. In a first non-limiting example, the thermal insulation layer may comprise one or more air gaps between the controller module and the motor housing. Alternatively, in another non-limiting example, the thermal insulation layer may comprise a thermal insulating material between the controller module and the motor housing.

In some implementations, the motor housing may comprise a flange member forming a rim about the front end of the motor housing and the heat transfer interface may be shaped to engage the flange member in a complementary manner.

In some implementations, the thermal conduction path established by the heat transfer interface between the controller module and the wet-end housing is a second thermal conductive path. The rim formed by the flange member includes a first partial rim member and a second partial rim member distinct from the first partial rim member, wherein:

- the first partial rim member cooperates with the heat transfer interface to establish a first thermal conduction path between the motor housing and the wet-end housing; and wherein
- the second partial rim member cooperates with the heat transfer interface to establish the second thermal conduction path between the controller module and the wet-end housing, said second partial rim member at least partially thermally insulating the controller module from the motor housing.

The second partial rim member may include a thermal insulation layer positioned between the controller module and the motor housing for at least partially thermally insulating the controller module from the motor housing. The thermal insulation layer may comprise one or more air gaps and/or a layer of thermal insulating material.

In some implementations, the second partial rim member may include a heat sink portion, the heat sink portion being configured to establish a thermal coupling with the controller module. The heat sink portion includes a controller-facing side configured to establish the thermal coupling with the controller module and a motor-housing-facing side shaped to conform to an outer surface of the motor housing. The motor-housing-facing side may be machined to create a thermal separation gap between the motor-housing-facing side and the outer surface of the motor housing, thereby providing some thermal insulation between the motor housing and the controller module.

These and other aspects of the disclosure will now become apparent to those of ordinary skill in the art upon review of the following description of embodiments of the disclosure in conjunction with the accompanying drawings.

All features of exemplary embodiments which are described in this disclosure and are not mutually exclusive can be combined with one another. Elements of one embodiment or aspect can be utilized in the other embodiments/aspects without further mention. Other aspects and features of the present invention will become apparent to those ordinarily skilled in the art upon review of the following description of specific embodiments in conjunction with the accompanying Figures.

BRIEF DESCRIPTION OF THE DRAWINGS

A detailed description of embodiments of the disclosure is provided below, by way of example only, with reference to the accompanying drawings, in which.

Figure 1:
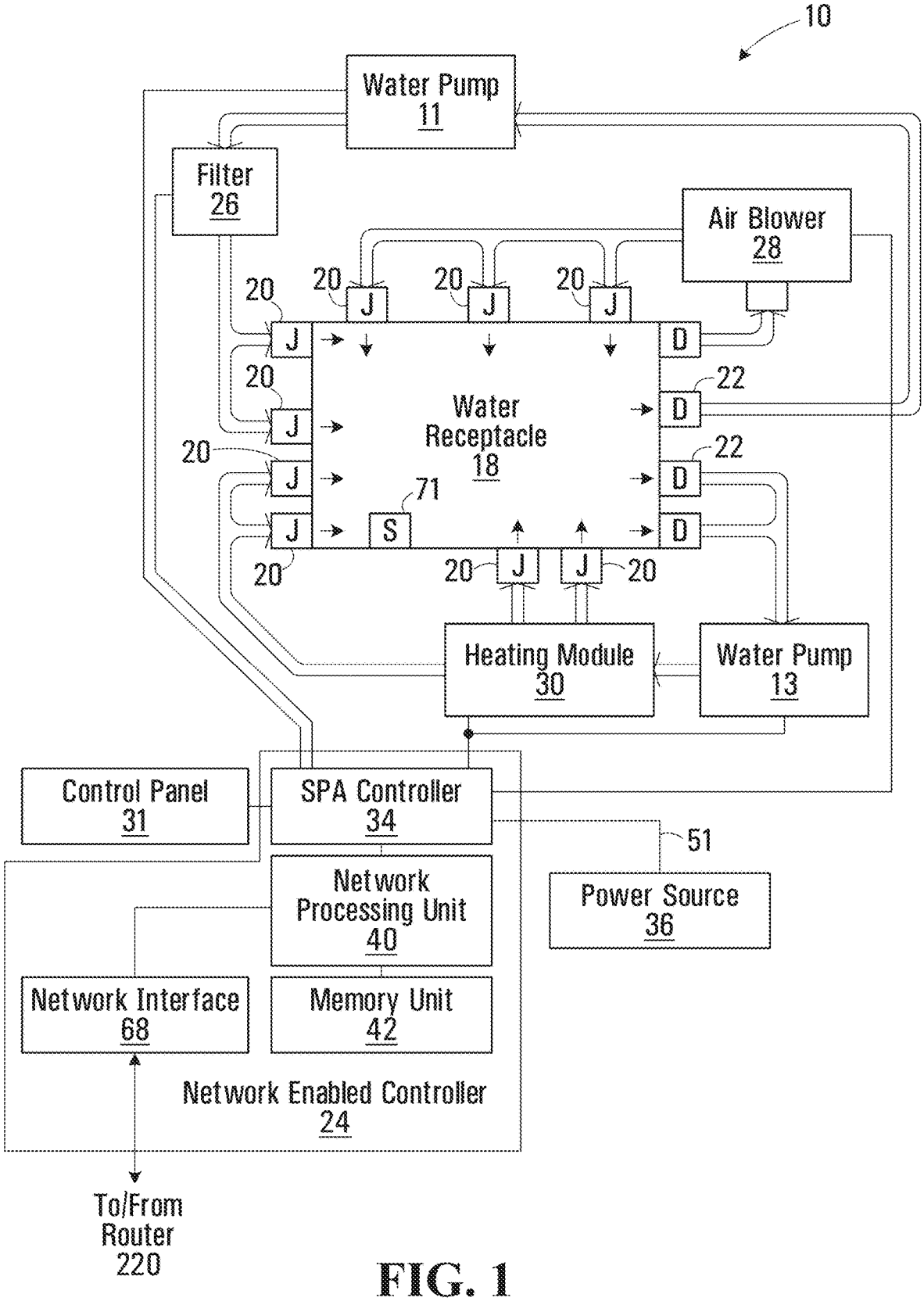
FIG. 1 shows a block diagram of a bathing unit system including one or more pump assemblies in accordance with a non-limiting embodiment of the invention.

In the drawings, the embodiments of the disclosure are illustrated by way of examples. It is to be expressly understood that the description and drawings are only for the purpose of illustration and are an aid for understanding. They are not intended to be a definition of the limits of the disclosure.

DETAILED DESCRIPTION

Specific examples of implementation of the disclosure will now be described with reference to the Figures.

The description below is directed to a specific implementation of a pump assembly in the context of a bathing unit system. It is to be understood that the terms "bathing system" or "bathing unit system", as used for the purposes of the present description, are used interchangeably and refer to spas, whirlpools, hot tubs, bathtubs, therapeutic baths, swimming pools and any other type of bathing unit that can be equipped with a pump assembly for circulating water to and from a water receptacle.

A bathing unit system typically includes a tub or basin that is suitable to contain a fluid such as water. In some embodiments the bathing unit system may include one or more stations that may each be occupied by one or more persons. In at least one station, one or more jets may be selectively located. As used herein, a "jet" refers to an orifice or nozzle through which a fluid may be pumped, discharged or dispensed into the tub. Jets may be provided in various shapes and sizes as commonly known in the art.

Bathing Unit System Overview

FIG. 1 is a block diagram of a bathing unit system 10 in accordance with an embodiment of the present disclosure. The bathing unit system 10 includes a water receptacle 18 for holding water, a plurality of jets 20, a set of drains 22 and a controller, which in the embodiment shown in a network-enabled controller 24. In the illustrative example shown in FIG. 1, the bathing unit system 10 includes a set of bathing unit components including a heating module 30, two water pumps 11 and 13, a filter 26 and an air blower 28. The bathing unit system 10 can include more or fewer bathing unit components. For example, although not shown in FIG. 1, the bathing unit system 10 could include an ozonator, a lighting system for lighting up the water in the water receptacle 18, multimedia devices such as an MP3 player, a CD/DVD player as well as other suitable devices.

In the non-limiting embodiment shown, the network-enabled controller 24 includes a spa functionality controller 34 for controlling the set of bathing unit components 11, 13, 26, 28, 30 and a network processing unit 40 for coordinating interactions between the spa controller and any external devices. Although FIG. 1 shows that the spa functionality controller 34 and the network processing unit 40 are two distinct components of the network-enabled controller 24, they can be implemented by a same physical processor and be part of the same physical device. The spa functionality controller 34 communicates with a user control panel 31, which enables a user to enter user commands for the spa functionality controller 34. In a specific embodiment, the user control panel 31 includes a display screen and a user input device (which can also be referred to as a user operable input). The user input device can include a trackball, mouse, gyroscope remote (which senses movement of the device in the air so as to move a cursor), a keypad, a touch sensitive screen, turn-dials, turn-and-push dials (such as idrive from BMW), a stylus pen or a microphone, among other possibilities. The user input device can include one or a combination of any or all of the above input devices.

The user control panel 31 provides an interface that allows a user to enter commands for causing the spa functionality controller 34 to control the various operational settings of the bathing unit components 11, 13, 26, 28, 30. Some non-limiting examples of operational settings include temperature control settings, jet control settings, and lighting settings, among other possibilities. In a non-limiting embodiment where the bathing unit is connected to entertainment and/or multimedia modules, the operational settings of the bathing unit may also include audio settings and video settings, amongst others. The expression "operational settings", for the purpose of the present disclosure, is intended to cover operational settings for any suitable bathing unit component or components that can be operated by a user of the bathing system.

In normal operation, water flows from the water receptacle 18, through the drains 22 and is pumped by water pump 13 through the heating module 30 where the water is heated.

The heated water then leaves the heating module 30 and re-enters the water receptacle 18 through the jets 20. In addition, water flows from the water receptacle 18, through different drains 22 and is pumped by the water pump 11 through the filter 26. The filtered water then re-enters the water receptacle 18 through different jets 20. Water can flow through these two cycles continuously while the bathing unit system 10 is in operation. Optionally, water can also flow from the water receptacle 18 through one or more drains 22 to the air blower 28 that is operative for delivering air bubbles to water that re-enters the water receptacle 18 through jets 20.

The network-enabled controller 24 receives electrical power from a power source 36 that is connected thereto via service wiring 51, e.g., an electric power source. The power source 36 supplies the network-enabled controller 24 with any conventional power service suitable for residential or commercial use.

The spa functionality controller 34 is configured for controlling the distribution of power supplied to the various bathing unit components 11, 13, 26, 28, 30 to cause desired operational settings to be implemented on the basis of program instructions and signals received from the user control panel 31 or from a device external to the bathing unit system 10 through the network processing unit 40. The spa functionality controller 34 may also receive control signals from various sensors 71 to cause the desired operational settings to be implemented. Manners in which the spa functionality controller 34 can be used to control the individual bathing unit components of the bathing system, such as for example the jets 20, the drains 22, the heating module 30, the water pumps 11 and 13, the filter 26, the air blower 28, a valve jet sequencer for massage, a variable speed pump with a pre-programmed massage setting, a water fall, an aroma therapy device and an atomizer, as well as any lighting and multimedia components, are known in the art and as such will not be described in further detail here.

The network-enabled controller 24 includes a network processing unit 40 for coordinating interactions between the spa functionality controller 34 and external devices. The network processing unit 40 is in communication with a memory unit 42 and a network interface 68. The network interface 68 may be of any suitable type known in the art including a wireless interface and wired interface. In a non-limiting implementation, the network interface 68 includes a wireless antennae suitable transmitting signal in a Wi-Fi network. Any suitable network interface, including, for example, a cellular interface, power line transmission and low power long range transmission (ex: LoRa, Sigfox), may be used in alternate embodiments. The memory unit 42 stores program instructions for execution by the network processing unit 40 for coordinating interactions between spa functionality controller 34 and any external devices. The network-enabled controller 24 is in communication with a router 202.

The memory unit 42 stores program instructions and data for use by the network processing unit 40. The data stored in the memory unit 42 includes, amongst others, information conveying operational settings associated with components in the bathing unit. For example, the operational settings may include temperature control settings, jet control settings, and lighting settings, among other possibilities. The memory unit 42 may also store water temperature information conveying water temperature measurements for water in the bathing system. The program instructions stored in the memory unit 42 when executed by the network processing unit 40 provide network related functionality which will be described in greater detail in the present application.

Pump Hardware

Figure 2:
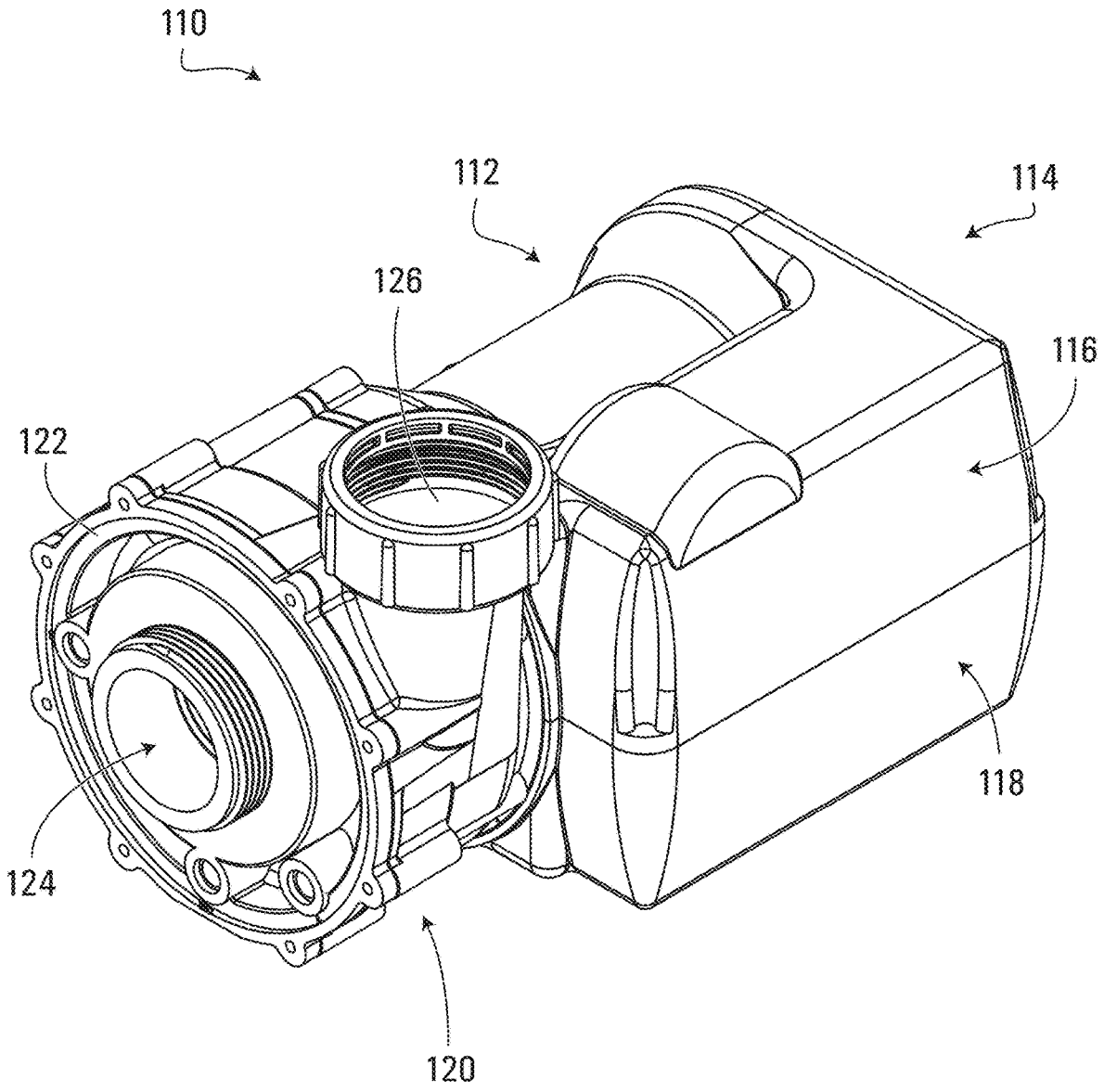
FIG. 2 shows a perspective view of a pump assembly in accordance with a non-limiting embodiment of the invention used in the bathing unit system of FIG. 1.

FIG. 2 shows a pump assembly 110 in accordance with a specific embodiment of the invention. For example, the pump assembly 110 can be the water pump 11 or the water pump 13 shown in FIG. 1. The pump assembly 110 has an external casing 112 that surrounds internal components of the pump assembly 110, including an electric motor 132 (shown in FIG. 4). The external casing 112 has a casing top portion 116 and a casing bottom portion 118 that together surround and define a pump dry section 114 of the pump assembly 110. The external casing 112 also includes a front casing 122 that surrounds and defines a wet-end housing 120 of the pump assembly 110. The wet-end housing 120 includes a water inlet port 124 and a water outlet port 126. Water is configured to flow through the wet-end housing 120 from the water inlet port 124 and out through the water outlet port 126. In some embodiments, the external casing 112 is made of a durable plastic material and acts as a protective barrier for the components of the pump assembly 110.

Figure 3:
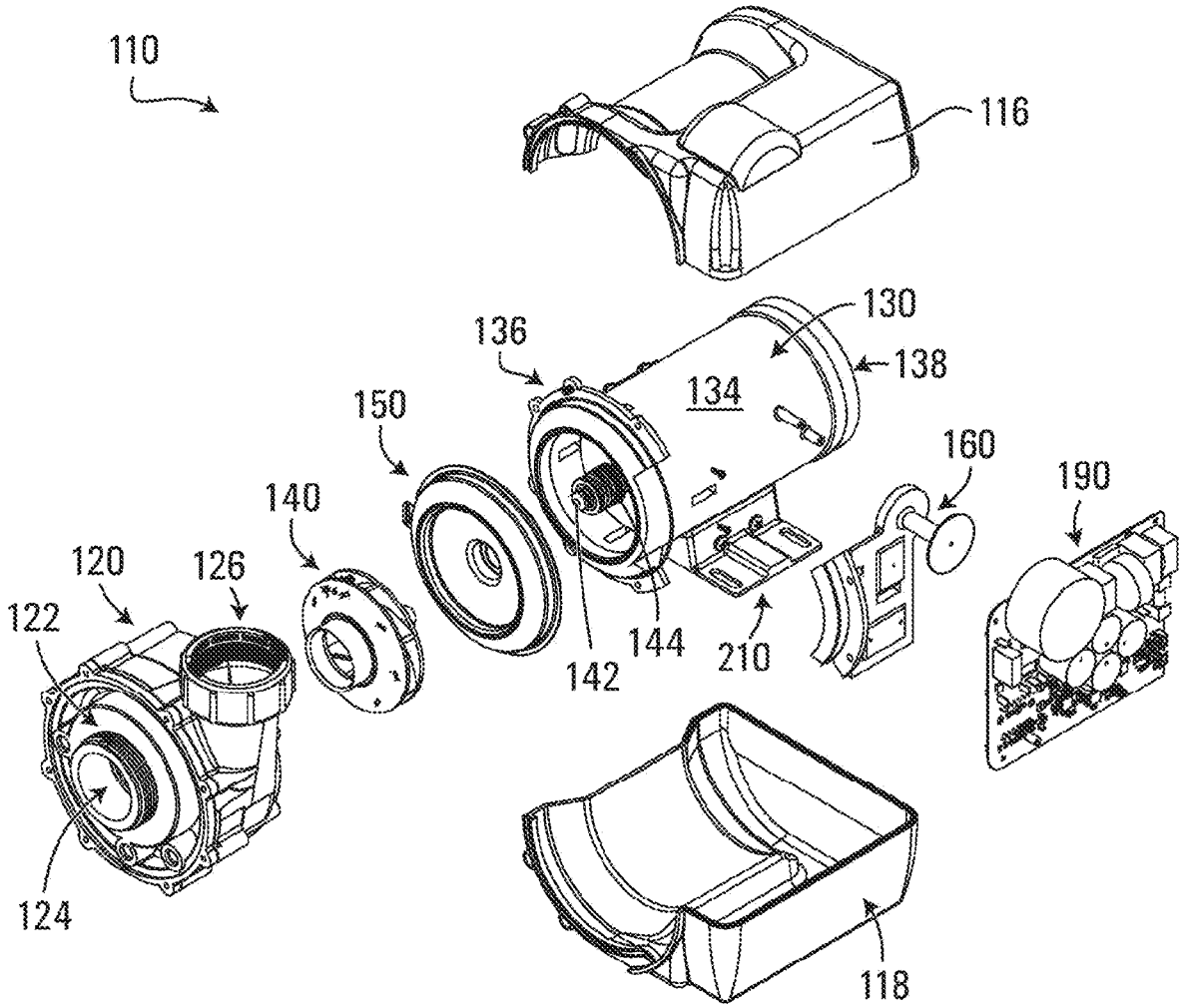
FIG. 3 shows a partial exploded view of the pump assembly of FIG. 2.
Figure 4:
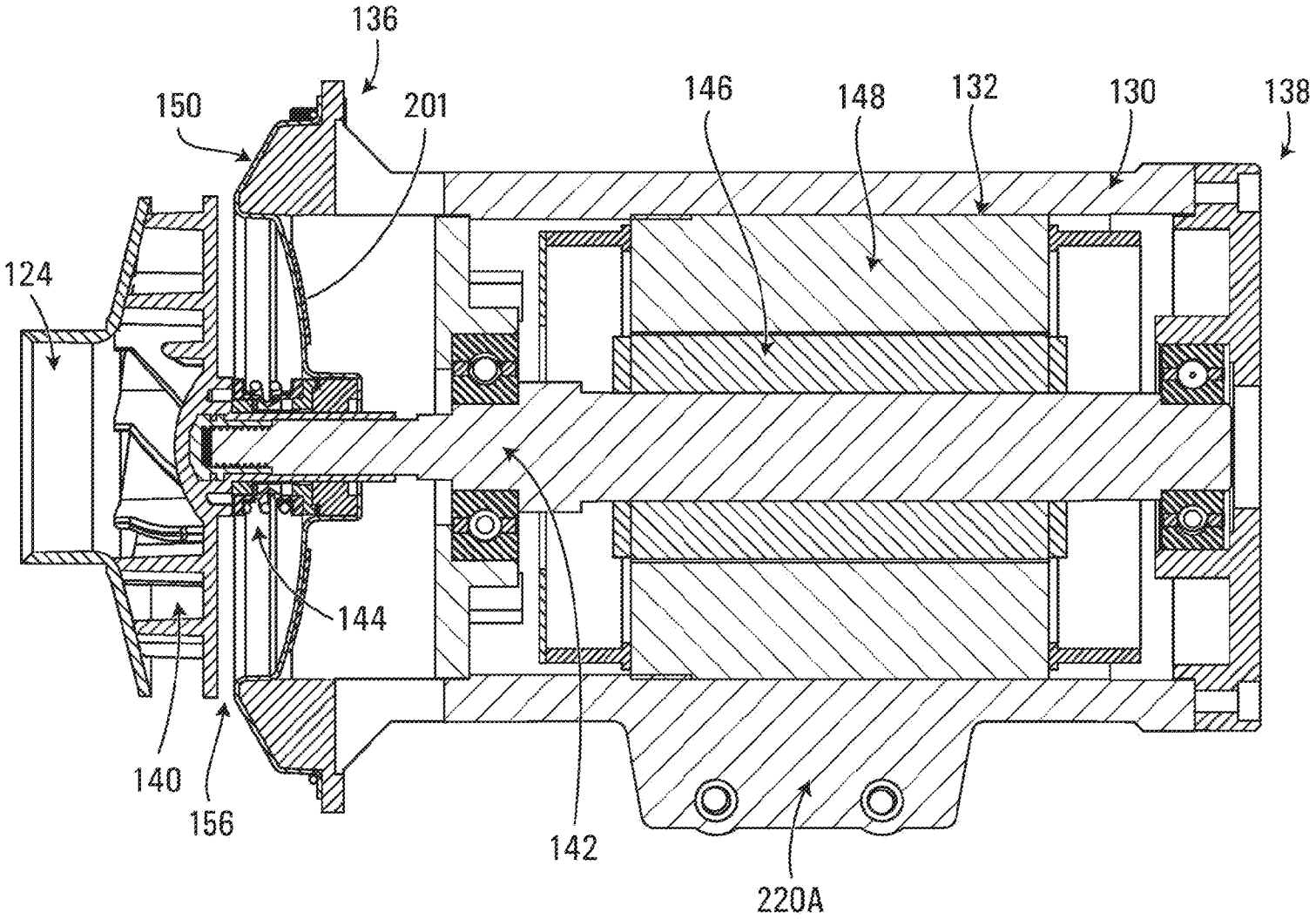
FIG. 4 shows a cutaway view of the pump assembly of FIG. 2.

FIG. 3 shows an exploded view of some of the pump components of the pump assembly 110 that are inside the external casing 112. Referring as well to FIG. 4, a motor housing 130 surrounds an electric motor 132, which includes a rotor 146 and stator 148. In the embodiment depicted, the motor housing 130 is generally cylindrical in shape with a curved housing lateral surface 134 separating a motor housing front end 136 and a motor housing back end 138. In some embodiments the motor housing 130 is made of aluminum although other suitable materials may be used in alternate implementations. The motor housing 130 is located within the pump dry section 114 and sealed from contact by the casing top portion 116 and the casing bottom portion 118 together with appropriate seals as is known in the art. In some embodiments the motor housing 130 is made of aluminum.

A rotor shaft 142 extends through the motor housing front end 136 of the motor housing 130. The rotor 146 of the electric motor 132 is mounted to the rotor shaft 142 that operationally connects with an impeller 140 positioned outside of the motor housing 130 and extends into the wet-end housing 120. The rotor 146 is caused to rotate by electricity being supplied to the stator 148. When rotated, the impeller 140 centrifugally forces water brought into the wet-end housing 120 through the water inlet port 124 out through the water outlet port 126.

A heat transfer interface 150 is provided on the motor housing 130 at the motor housing front end 136. The heat transfer interface 150, which in the embodiment depicted has a generally circular/disc shape, is positioned between a rear surface of the impeller 140 and the front surface of the motor housing front end 136. A central aperture 152 in the heat transfer interface 150 (better shown in FIG. 7A) allows the rotor shaft 142 of the electric motor 132 to extend therethrough.

Optionally, in some embodiments, the motor housing front end 136 may include an active heating element 201 for heating water that flows through the pump assembly 110. The heating element 201 can be made using different technologies such as, but without being limited to thick film, tubular heating element, ceramic heating element. In a specific example of implementation, the heating element 210 is mounted to the dry side of the heat transfer interface 150. The element can be welded, brazed, glued or laminated to the heat transfer interface. It is appreciated that the active heating element may be positioned elsewhere than on the heat transfer interface 150 within the motor housing front end 136 provided it is positioned such as to avoid interfering with the movement of propeller 140 of the pump assembly 110.

In some practical implementations, the controller component 190 of the pump assembly 110 may be configured for selectively operating the active heating element 201 in dependence on a status of operation of the electric motor 132. For example, when the pump assembly 110 is a variable speed pump, the controller component 190 of the pump assembly 110 may be programmed to selectively provide electrical power to the active heating element 201 to actively heat water circulating only when the electric motor 132 operates at an intensity level below a threshold intensity level. As another example, the controller component 190 of the pump assembly 110 may be programmed to selectively provide electrical power to the active heating element 201 to actively heat water circulating only when the motor housing 130 has a temperature below a threshold temperature. The temperature the motor housing 130 may be measured by a temperature probe (not shown in the Figures) in proximity to the motor housing 130 and in communication with the controller component 190.

In use, recirculating water from the bathing unit system 10 enters the wet-end housing 120 of the pump assembly 110. However, it is undesirable for that water to move into the motor housing 130 and contact the electric motor 132. Therefore, various seals whose function is to prevent the passage of water into the motor housing 130 are distributed at various locations. For example, the rotor shaft 142 is surrounded by spring seal components 144 and 145 whose function is to prevent the conducting of water into the motor housing 130. The rotor shaft 142 is also equipped with bearings that facilitate its rotation.

A partial rim member 160 is attached to the motor housing 130 at the motor housing lateral surface 134 and extends between a circuit board-mounted controller 190 and the motor housing 130. The partial rim member 160 is shaped so that it generally fits the contours of the motor housing lateral surface 134 of the motor housing 130 on a first surface and supports the circuit board-mounted controller 190 on the other. The circuit board-mounted controller 190 is in communication with the electric motor 132 within the motor housing 130 to supply electric current to operate the electronic motor 132. The circuit board as well as the electric motor 132 generate heat during operation.

Mounting brackets 220A 220B are also attached to the motor housing 130 on the motor housing lateral surface 134. The pump mounting brackets 220A 220B function to fixedly secure the pump assembly 110 at its desired installed location within a spa by a series of mechanical fasteners (shown in FIG. 13).

Pump Cooling Features

The motor housing 130 is located in what is referred to as the pump dry section 114, indicating that water from the bathing unit system 10 is prevented from making contact with the electric motor 132 within.

Figure 5:
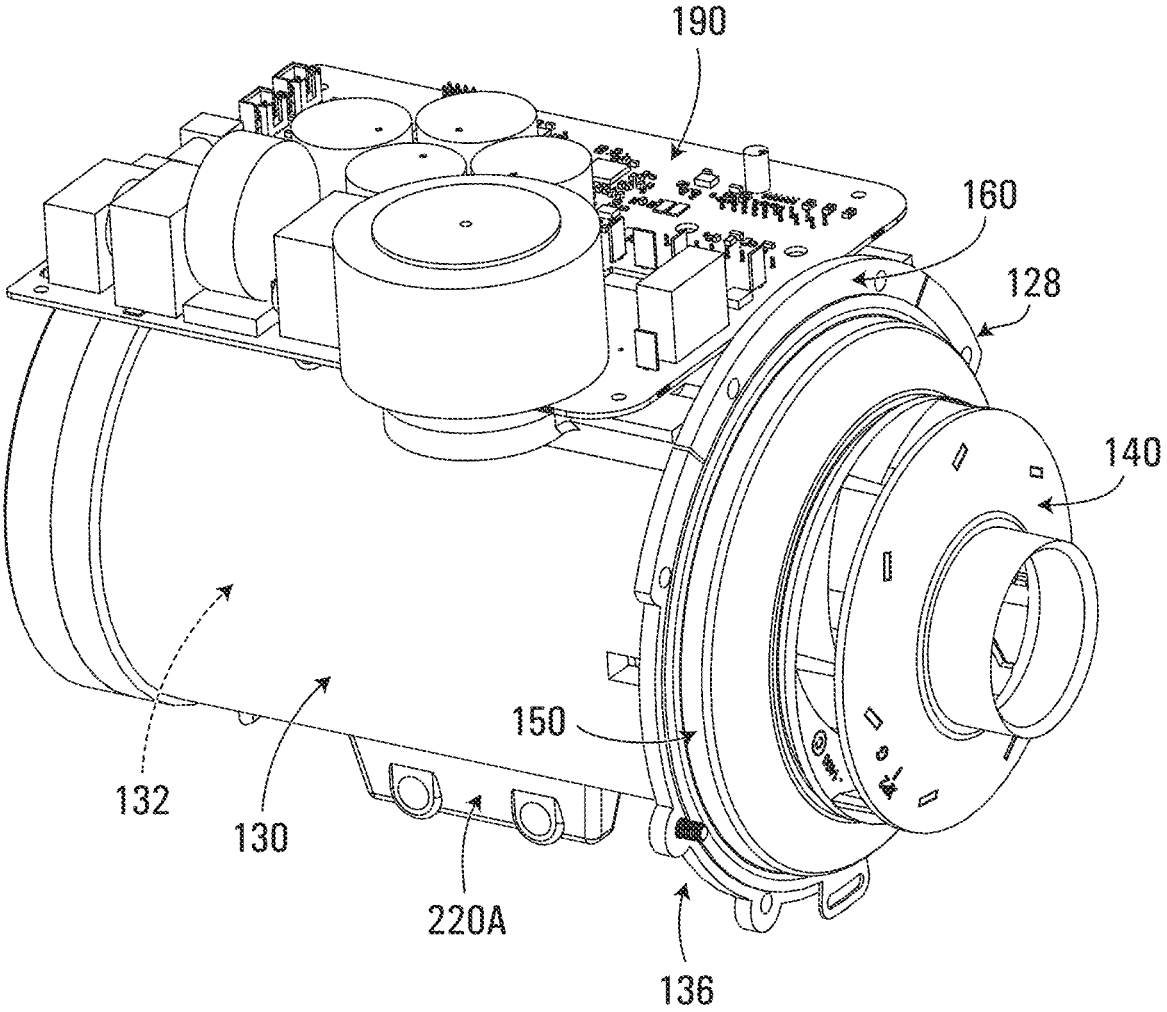
FIG. 5 shows a perspective view of the pump assembly of FIG. 2 in which an external casing has been removed to reveal some internal components of the pump assembly.
Figure 6:
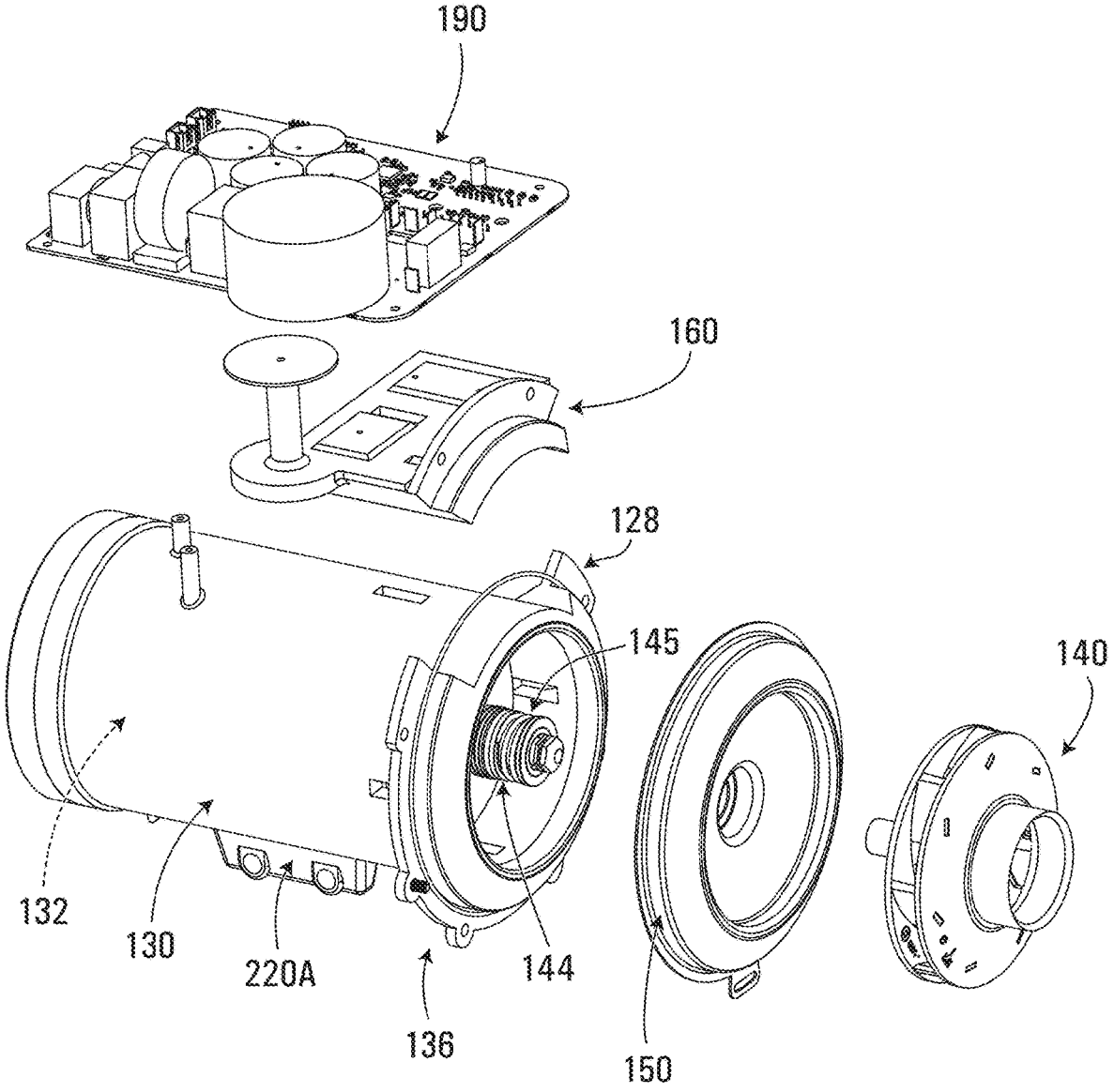
FIG. 6 shows a partial exploded view of the pump assembly components shown in FIG. 5.

FIG. 5 and FIG. 6 show perspective assembled and exploded views, respectively, of some of the components of the pump assembly 110 that are involved in the heat exchange process to transfer heat away from the motor housing 130 and the circuit board mounted controller 190 towards water circulating through the pump assembly. A typical installation would be, as previously mentioned, in conjunction with a hot tub, spa or therapy pool. Typically, the water within these types of tubs is constantly being recirculated. The movement of the water through the recirculating system is accomplished by a pump with the pump assembly 110 being such a pump. Electrical power is supplied to the stator 148 and rotor 146 of the electric motor 132 which results in the rotor 146 and the rotor shaft 142 rotating. This rotation causes rotation of the impeller 140 which results in water being pumped from the water inlet port 124 to the water outlet port 126 in the wet-end housing 120 of the pump assembly 110.

The operation of the electric motor 132 generates heat within the motor housing 130. This heat is transferred from within the motor housing 130 to the water travelling through the wet-end housing 120 along a first thermal conductive path. This heat transfer takes place across the heat transfer interface 150 that is positioned at the motor housing front end 136.

The motor housing 130 has a flange member forming a rim 128 160 about the front end 136 of the motor housing 120. When the heat transfer interface 150 is assembled with the motor housing 130, the heat transfer interface 150 fits around and is supported by the flange member. While in some embodiments, the rim formed by the flange member may be constructed as a single unitary piece, in the specific example depicted, the rim formed by the flange member includes a first partial rim member 128 and a second partial rim member 160 distinct from the first partial rim member 128 so that there is a discontinuity between the first partial rim member 128 and the second partial rim member 160 when they are positioned next to one another to form the rim.

As best shown in FIG. 6, in the embodiment depicted, the first partial rim member 128 is formed as a unitary piece of the motor housing body and has a missing arc where portion is flat with the rest of the surface of the motor housing 130. This missing arc is filled by the second partial rim member 160, which is a separately machined or die-casted component of the motor housing 120 so that when the second partial rim member 160 and the motor housing 130 are assembled, the first partial rim member 128 and the second partial rim member 160 form a near complete arc around the perimeter of the motor housing front end 136, as seen in FIG. 5.

Figure 7A:
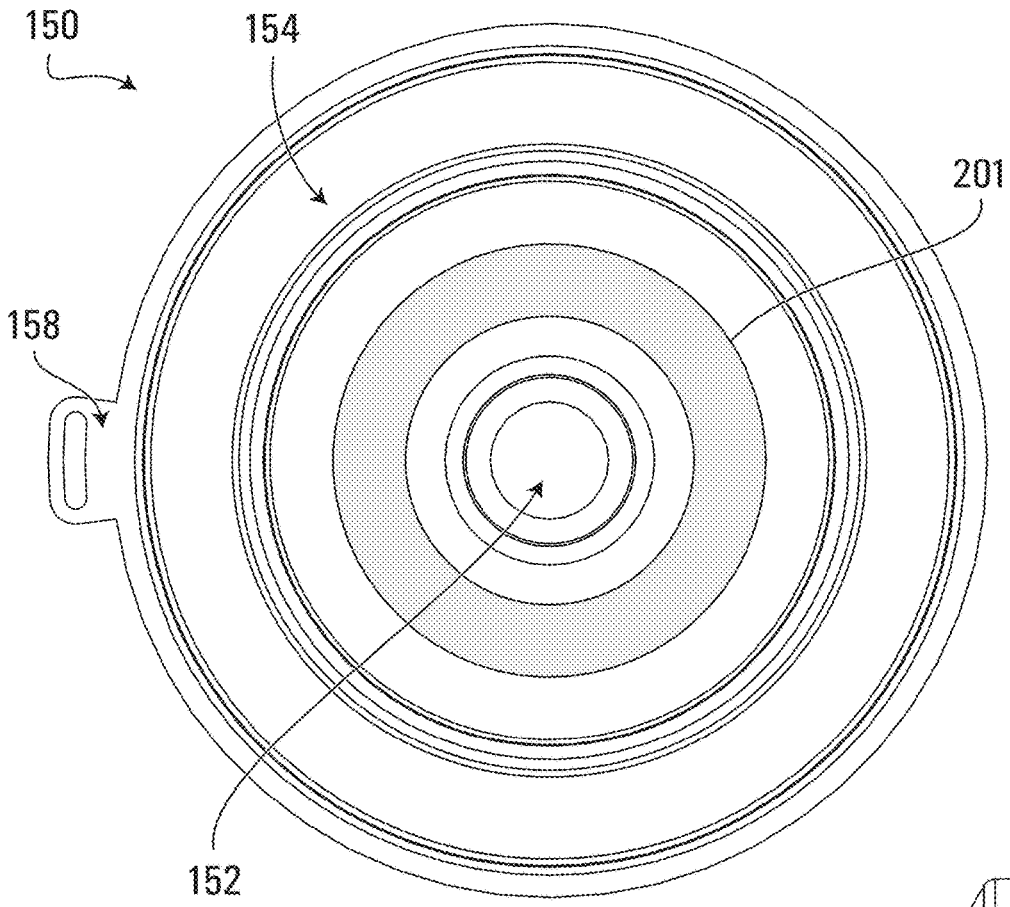
FIGS. 7A and 7B show front and side views of a heat transfer interface used in the pump assembly of FIG. 2.
Figure 7B:
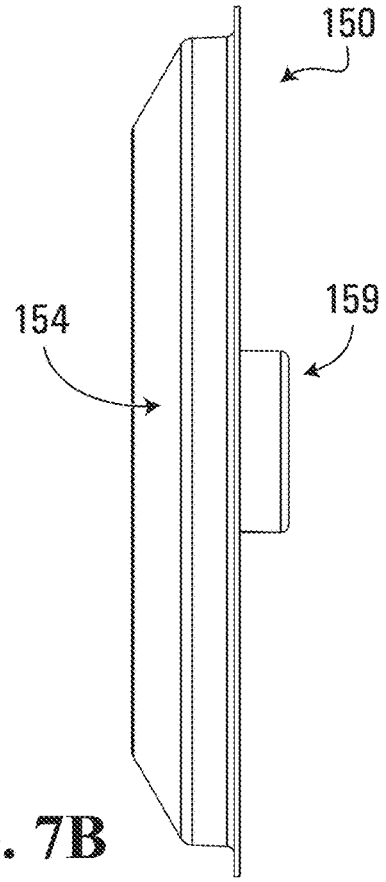

FIGS. 7A and 7B show front and side views of the heat transfer interface 150. The heat transfer interface 150 has a heat transfer interface body 154 that is generally circular in shape in the embodiment shown. The heat transfer interface body 154 is sized and shaped to fit over and to cover the motor housing front end 136, acting as an end cap that covers the water-facing end of the motor housing 130.

The heat transfer interface 150 includes a first surface engaged with the front end of the motor housing and a second surface opposed to the first surface, wherein when the pump assembly is in use, at least a portion of the second surface is exposed to water flowing through the wet-end housing.

The central aperture 152 of the heat transfer interface 150 permits the rotor shaft 142 of the electric motor 132 to extend through the heat transfer interface body 154 and mate with a rear surface of the impeller 140. The heat transfer interface 150 also includes a protrusion 159 that is sized and shaped to accommodate the positioning and movement of the spring seal 144 and 145 on the rotor shaft 142. In the example depicted, the heat transfer interface 150 also includes a side ground connector ring 158 for facilitating grounding the heat transfer interface 150.

When assembled with the motor housing 130, the heat transfer interface 150 is fixed to the motor housing 130 on its back surface, with the rotor shaft 142 of the electric motor 132 passing through the central aperture 152. The impeller 140 is positioned for rotation near the front surface of the heat transfer interface 150. As best seen in FIG. 4, the impeller 140 is not flush with the front surface of the heat transfer interface 150. Instead, there is a gap 156 between the front surface of the heat transfer interface 150 and the rear surface of the impeller 140, that allows the water circulating in the wet-end housing 120 to contact the front surface of the heat transfer interface 150. This contact facilitates heat transfer between the electric motor 132 and the recirculating water as heat flows from the electric motor 132 to the water along a first thermal conductive path.

The heat transfer interface 150 may be coupled to the front end of the motor housing using any suitable fastening technique including, without being limited to, an induction heat shrinking process, a welding process, a brazing process, through the use of an adhesive and/or using one or more mechanical fasteners, such as clamps, screws and the like.

In specific implementations, the heat transfer interface 150 may be made of different types of materials. In some implementations, the heat transfer interface 150 may be made of a thermally conductive material, such as but not limited to, a material that includes copper and/or aluminum. While such materials can provide useful thermal conduction properties, since the heat transfer interface 150 is in contact with water from the bathing unit, and since such water may contain corrosive materials (such as salts and chemicals), the heat transfer interface 150 may need to be replaced more frequently due to wear.

As such, in practical implementations, it may be desirable that the material of the heat transfer interface 150 not corrode and is chemical-resistant to prolong the life of the heat transfer interface 150 in operation even if the thermal conductivity of the material used may be lower than materials such as copper and/or aluminum. For example, the heat transfer interface 150 can be made of a material such as stainless steel, or titanium. While such materials are not typically considered to have good thermal conduction properties, it has been found that their respective levels of conduction can be sufficiently suitable to establish a thermal conduction path between the motor housing 130 and the wet-end housing 120. In addition, materials such a stainless steel and titanium are generally resistant to corrosion and thus, since the heat transfer interface 150 is at least partially in contact with water containing corrosive materials, the use of such materials may extend the useful life of the pump assembly 110 and/or may reduce the frequency of required repairs and maintenance.

The thickness of the heat transfer interface 150 may vary between implementations however it has been found that thinner designs have improved heat transfer properties in particular where the material used to make the heat transfer interface 150 has a lower thermal conductivity. In specific examples of implementation, the heat transfer interface 150 is made of aluminum and has an average thickness of less than 2 mm thick; e.g., less than 1.5 mm; less than 1 mm; less than 0.5 mm. In a non-limiting example of implementation, the average thickness of the heat transfer interface 150 is selected to be about 1.016 mm (which corresponds to approximately 0.040") and the material is selected to be stainless steel.

A thermal interface material with a higher thermal conductivity than that of air may be used to fill at least some voids between the first surface of the heat transfer interface 150 and the motor housing front end 136, to improve the thermal conductivity between the heat transfer interface 150 and the motor housing front end 136. This improvement occurs as the material fills any voids created by surface roughness effects, defects and misalignment between the transfer interface 150 and the motor housing front end 136. This filling allows heat transfer to occur due to conduction across the actual (solid) contact area rather than by conduction (or natural convection) and radiation across the gaps. Properly applied thermal interface materials displace the air that is present in the gaps between the two objects with a material that has a much higher thermal conductivity (e.g., 0.3 W/m·K and higher compared has a thermal conductivity of 0.022 W/m·K for air).

Various types of suitable thermal interface materials may be used such as a thermal gap filler material, including but not limited to thermal pastes and thermal pads. Thermal paste is also called thermal compound, thermal grease, thermal interface material, thermal gel, heat paste, heat sink compound, or heat sink paste. Generally, selection of a thermal interface material is based on the interface gap which the material must fill, the contact pressure, and the electrical resistivity of the thermal interface material. In some embodiments, such pastes can include particles of different sizes and different thermal conductivities, which may be suspended in a suitable binder such as, but without being limited to, a silicone binder or a ceramic binder.

Specific non-limiting examples of thermal pastes for use between the first surface of the heat transfer interface 150 and the motor housing front end 136 include silicone based thermal pastes, ceramic-based thermal pastes, metal-based pastes, carbon-based pastes, diamond carbon pastes and liquid metal-based thermal paste.

It is noted that, while in the embodiments described with reference to the Figures, the heat transfer interface 150 is a component distinct from the motor housing 130, in alternate embodiments the heat transfer interface 150 may form an integral physical part of the motor housing 130. For example, the heat transfer interface 150 may be permanently attached to the motor housing 130, for example using welding, brazing of lamination process. Alternatively, the motor housing 130 itself may be made from a material resistant to corrosion and therefore the front portion of the motor housing 130 itself may behave as a heat transfer interface.

Referring back to FIGS. 5 and 6 heat is also generated by the circuit board mounted controller 190 that is exterior to the motor housing 130. The heat generated by the circuit board mounted controller 190 must be dissipated to prevent damage and/or premature failure of the electronic components. Rather than using conventional large fin-based heat sinks to dissipate heat in the air, the heat generated by the circuit board mounted controller 190 is transmitted through the heat transfer interface 150 to the water flowing through the wet-end housing 120 and thereby used as a source heat for the water in the bathing unit system.

In the embodiment depicted in the figures, the thermal conductive path between the circuit board mounted controller 190 and the wet-end housing 120 is distinct from the thermal conductive path between the motor housing 130 and the wet-end housing 120.

Figure 8A:
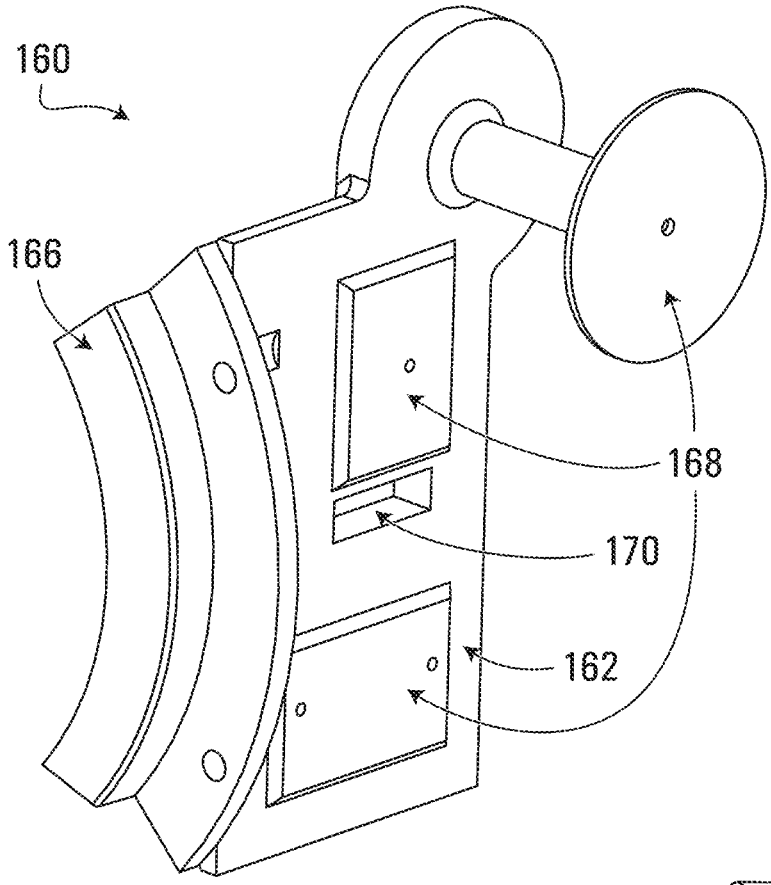
FIGS. 8A and 8B show perspective views of a (second) partial rim member of the motor housing of the pump assembly of FIG. 2, wherein the (second) partial rim member includes a heat sink portion.
Figure 8B:
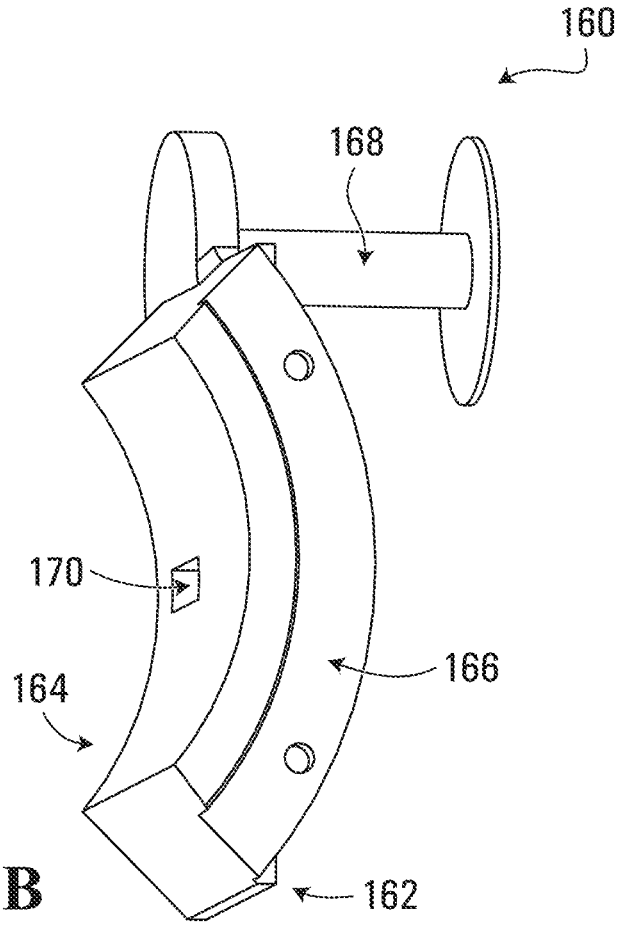

Referring as well to FIGS. 8A and 8B, the separate the first partial rim member 128 and the second partial rim member 160 acts to partially thermally insulate the circuit board-mounted controller 190 and the motor housing 130 from each other by creating a discontinuity in the thermal conductivity between the circuit board mounted controller 190 and the motor housing.

In the embodiment depicted, the second partial rim member 160 has a heat sink portion with a (top) a controller-facing side 162, a (bottom) motor-housing-facing side 164, and a forward-facing edge or lip 166. The controller-facing side 162 includes various surface features 168 shaped and sized to mate with and support components of the circuit board-mounted controller 190. A wire access hole 170 is provided through the body of the second partial rim member 160 from the motor-housing-facing side 164 to the controller-facing side 162 to permit wires (not shown) to pass therethrough. These wires enable electric power to flow between the electric motor 132 inside the motor housing 130 and the elements of the circuit board-mounted controller 190. In some embodiments the second partial rim member 160 may be made of the same material as the motor housing 130. In some embodiments the second partial rim member 160 is made of aluminum.

As best shown in FIG. 8B, the motor-housing-facing side 164 of the second partial rim member 160 is curved. The curvature of the motor-housing-facing side 164 is chosen to generally match the curvature of the motor housing lateral surface 134 such that the motor-housing-facing side 164 contours to the motor-housing-facing side 134.

In some embodiments, the second partial rim member 160 is separate from the motor housing 130, as shown in FIGS. 3 and 6. In such embodiments, the second partial rim member 160 can be attached to the motor housing, e.g., by mechanical fasteners such as screws.

The lip 166 of the second partial rim member 160 is in the shape of an arc on the forward-facing front surface of the second partial rim member 160. As best seen in FIGS. 5 and 6, when the second partial rim member 160 is assembled with the motor housing 130, the lip 166 fits into the missing portion of first partial rim member 128 of the motor housing front end 136. The lip 166 is an arc that fills the mission portion of the first partial rim member 128 such that when assembled, second partial rim member 160 and the first partial rim member 128 together form a rim around the perimeter of the motor housing front end 136.

As mentioned above, the second partial rim member 160 is configured to thermally insulate the circuit board-mounted controller 190 and the motor housing 130 from each other. This thermal insulation is accomplished in various manners. In the embodiment shown, the second partial rim member 160 is a separate part from the motor housing 130. When assembled, the second partial rim member 160 and the motor housing 130 are physically attached; however, the second partial rim member 160 being a separate part from the motor housing 130 causes a thermal discontinuity at the points where the two parts touch. This discontinuity results in at least a partial decoupling of the heat conduction between the motor housing 130 and the circuit board-mounted controller 190.

Other embodiments of the second partial rim member 130 thermally insulate the circuit board-mounted controller 190 from the motor housing 130 are also possible.

For example, a thermal insulation layer may be provided between the circuit board-mounted controller 190 and the motor housing 130, for example on a lower surface of the second partial rim member 160, to reduce an amount of heat transfer between the circuit board-mounted controller 190 and the motor housing 130. The thermal insulation layer may comprise one or more air gaps between the circuit board-mounted controller 190 and the motor housing 130 and/or it may comprise a thermal insulating material between the controller module and the motor housing.

Figure 9A:
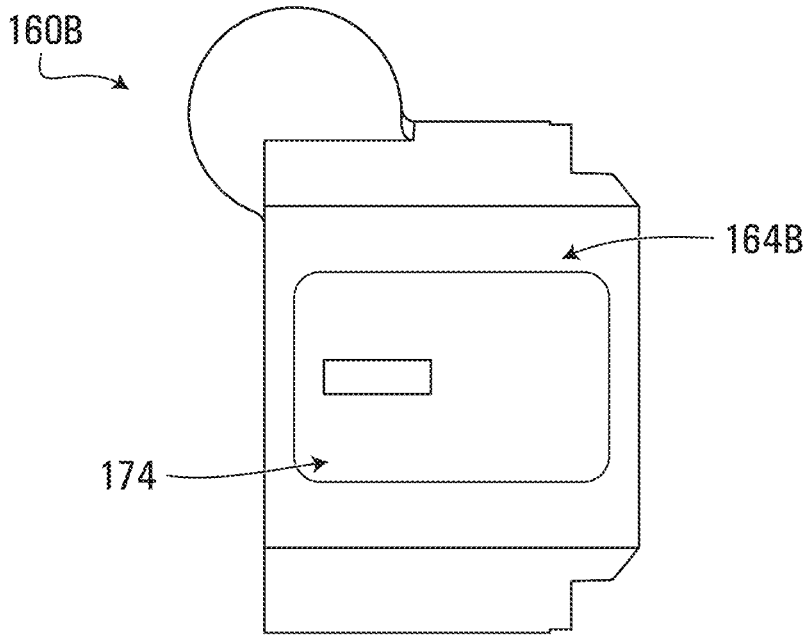
FIGS. 9A and 9B show bottom plan views of the (second) partial rim member depicted in FIGS. 8A and 8B accordance to two different embodiments.

For example, FIG. 9A shows an embodiment of the second partial rim member 160, namely second partial rim member 160B that is similar to the partial rim member 160, with additional heat insulation features on a motor-housing-facing side 164B. The heat insulation features as shown include a thermal separation gap 174. The thermal separation gap 174 is a blind hole that thins the body of the second partial rim member 160B such that there is an air gap between that portion of the motor-housing-facing side 164B of the second partial rim member 160B and the motor housing lateral surface 134. This air gap enhances the thermal insulation of the two parts.

Figure 9B:
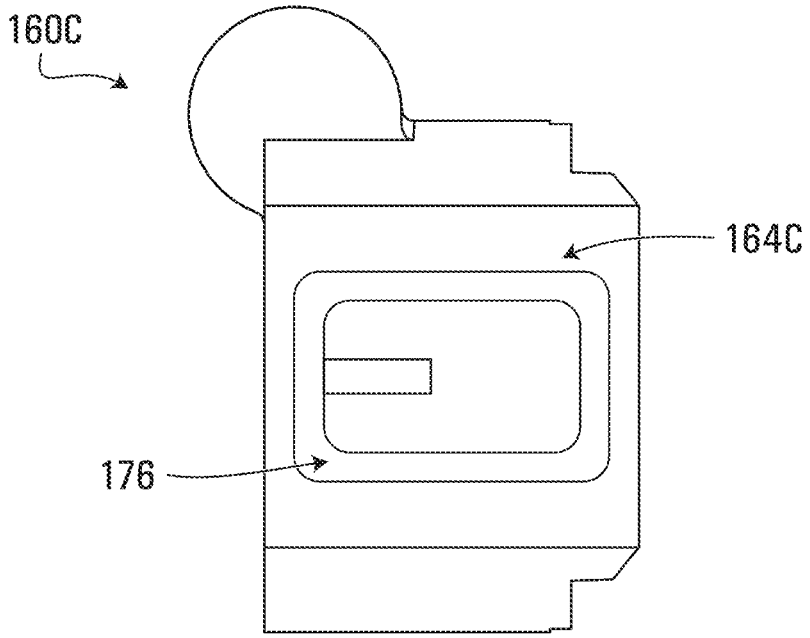

The additional heat insulation features on a rear side of the second partial rim member 160 can take other forms. For example, FIG. 9B shows another embodiment of the second partial rim member 160, namely second partial rim member 160C that is similar to the partial rim member 160, where the additional heat insulation features on a motor-housing-facing side 164C include of a thermal separation groove 176. The thermal separation groove 176 is a blind hole that thins the body of the second partial rim member 160C such that there is an air gap between that portion of the motor-housing-facing side 164C and the motor housing lateral surface 134. Other arrangements are also possible. For example, the additional heat insulation features can be circular, rather than generally rectangular as shown, or any other shape such an octagon-based prism, or can be a series of prongs, etc.

Figure 10:
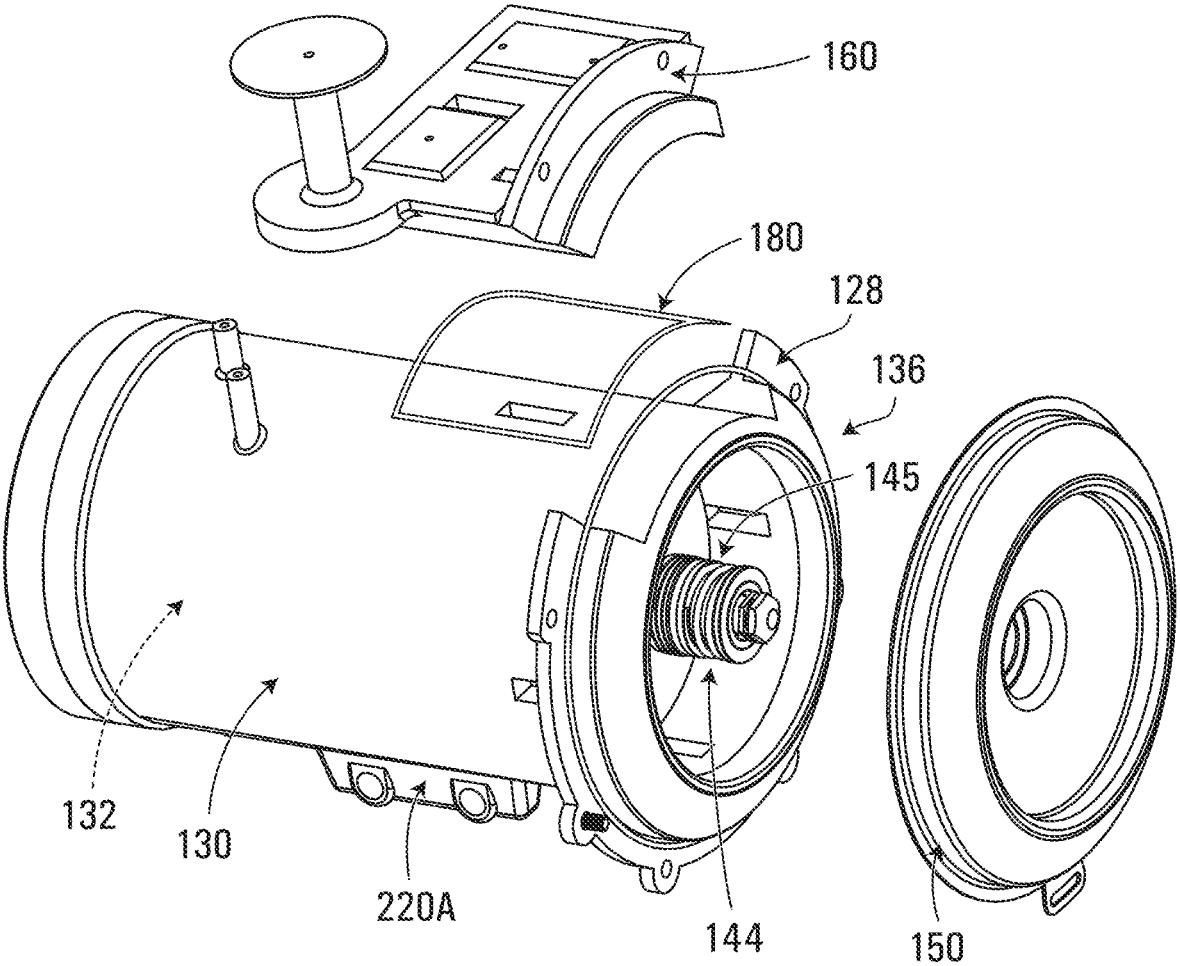
FIG. 10 shows an exploded view of the pump assembly of FIG. 2 including a thermal insulation layer in accordance with a specific embodiment.

Referring to FIG. 10, in some embodiments a thermal insulation layer 180 comprising a thermal insulating material is provided to enhance the thermal insulation of the partial rim member 160 and the attached circuit board-mounted controller 190. The thermal insulation layer 180 can be made of any suitable thermally insulating material such as plastic, mylar, Kevlar™, fiberglass, adhesives or any materials. The thickness of the thermal insulation layer 180 can vary between implementations and depending on the type of material used as well as the desired amount of insulation to be achieved. In a specific practical implementation, a thermal insulation layer made of a plastic material and having a thickness between 0.5 mm and 2 mm is used.

When assembled as shown in FIG. 5, the heat transfer interface 150 is in contact with the flange 128 of the motor housing 130 and with the lip 166 of the partial rim member 160. The recirculating water is supplied into water inlet port 124 into the pump assembly 110 and then out via the water outlet port 126 under force of the impeller 140 in the wet-end housing 120. Heat generated from the circuit board-mounted controller 190 and from the electric motor 132 within the motor housing 130 is transferred via the heat transfer interface 150 to the water flowing past its front face in the second thermal conduction path.

Figure 11A:
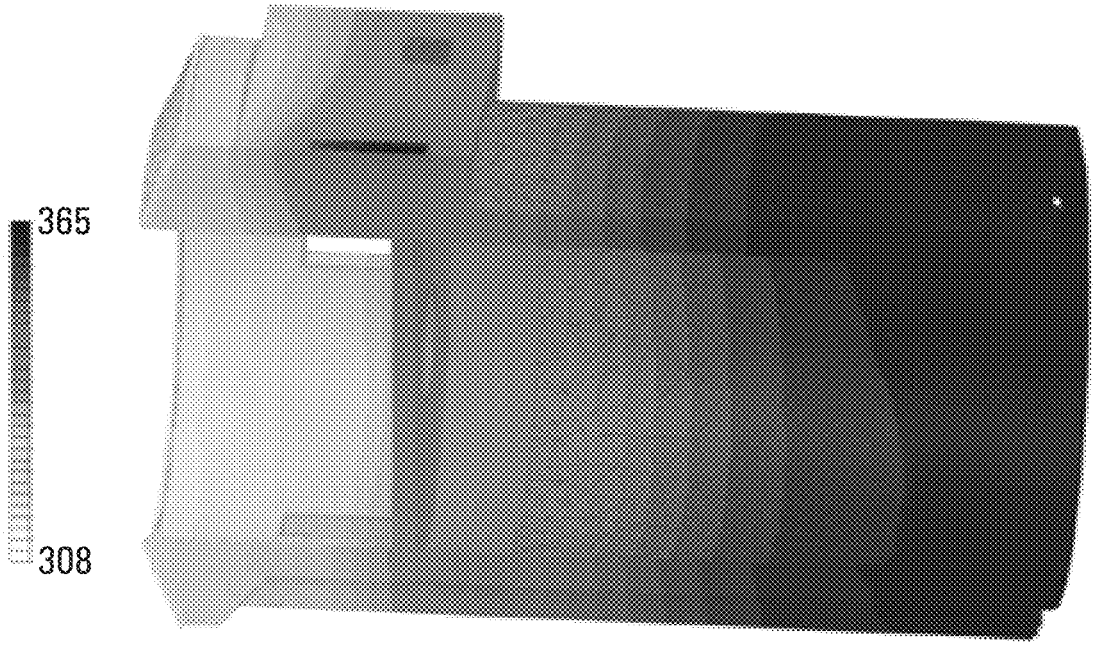
FIGS. 11A and 11B show computer software-generated heat map images of the motor housing of a pump assembly in accordance with two different configurations.
Figure 11B:
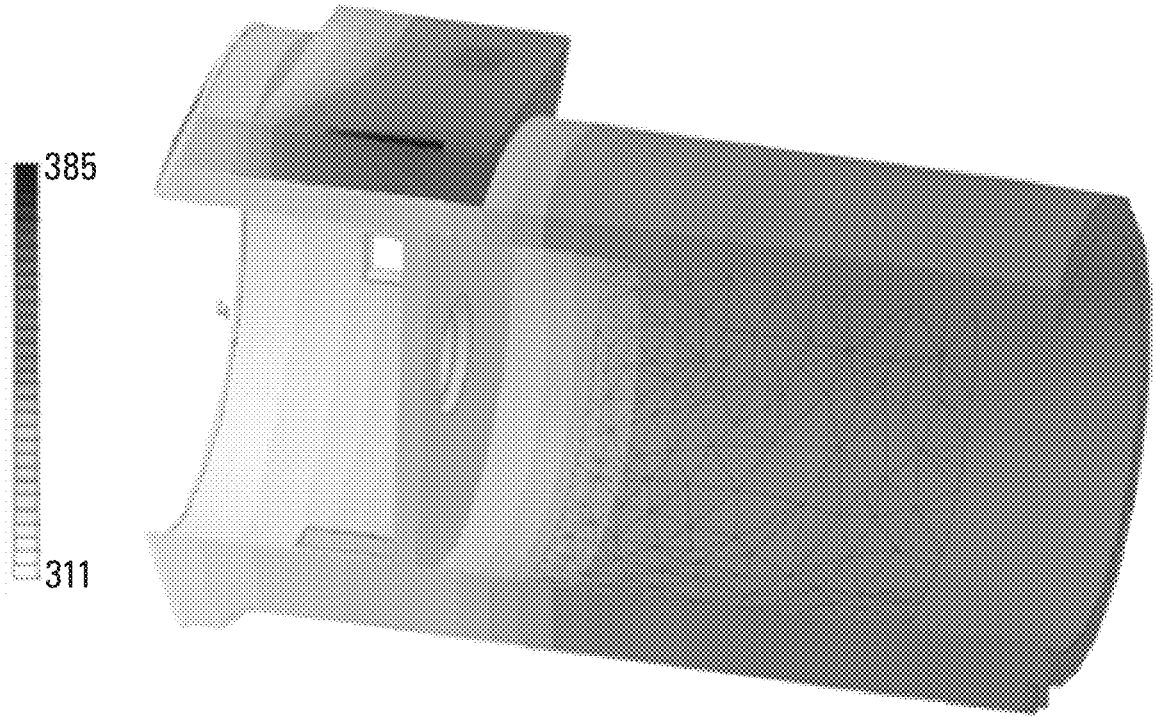

FIGS. 11A and 11B illustrate the effectiveness of use of the second partial rim member 160. FIG. 11A is a computer software-generated thermal heat map of a motor housing 130 where the second partial rim member 160 and the first partial rim member 128 are constructed as a unitary piece (thus eliminating the discontinuity in thermal conductivity) and where there is very little or no thermal insulation between the circuit board-mounted controller 190 and the motor housing 130. FIG. 11B is a thermal heat map of the motor housing 130 with the second partial rim member 160 described with reference to FIGS. 8A to 10. As can be observed, the overall temperature distribution is much wider for the traditional motor casing of FIG. 11A with temperatures ranging from approximately 310K (Kelvin) to approximately 365K. By contrast, the simulation results of the second partial rim member 160 assembled with the motor housing 130 shown in FIG. 11B show a temperature range of between approximately 310K and 350K. The temperature range in the region of the second partial rim member 160 is also generally lower in FIG. 11B, roughly 2-3K lower than the equivalent region in FIG. 11A.

While the pump assembly 110 is being operated, there is a constant steady flow of water through the front casing 122. For a typical bathing unit system, the amount of heat generated from the pump assembly 110 may complement dedicated heaters in the system and help maintain the water temperature at a desired temperature level while reducing the energy requirement for operating additional heaters in the bathing unit system.

Pump Mounting Brackets 220A 220B

Figure 12:
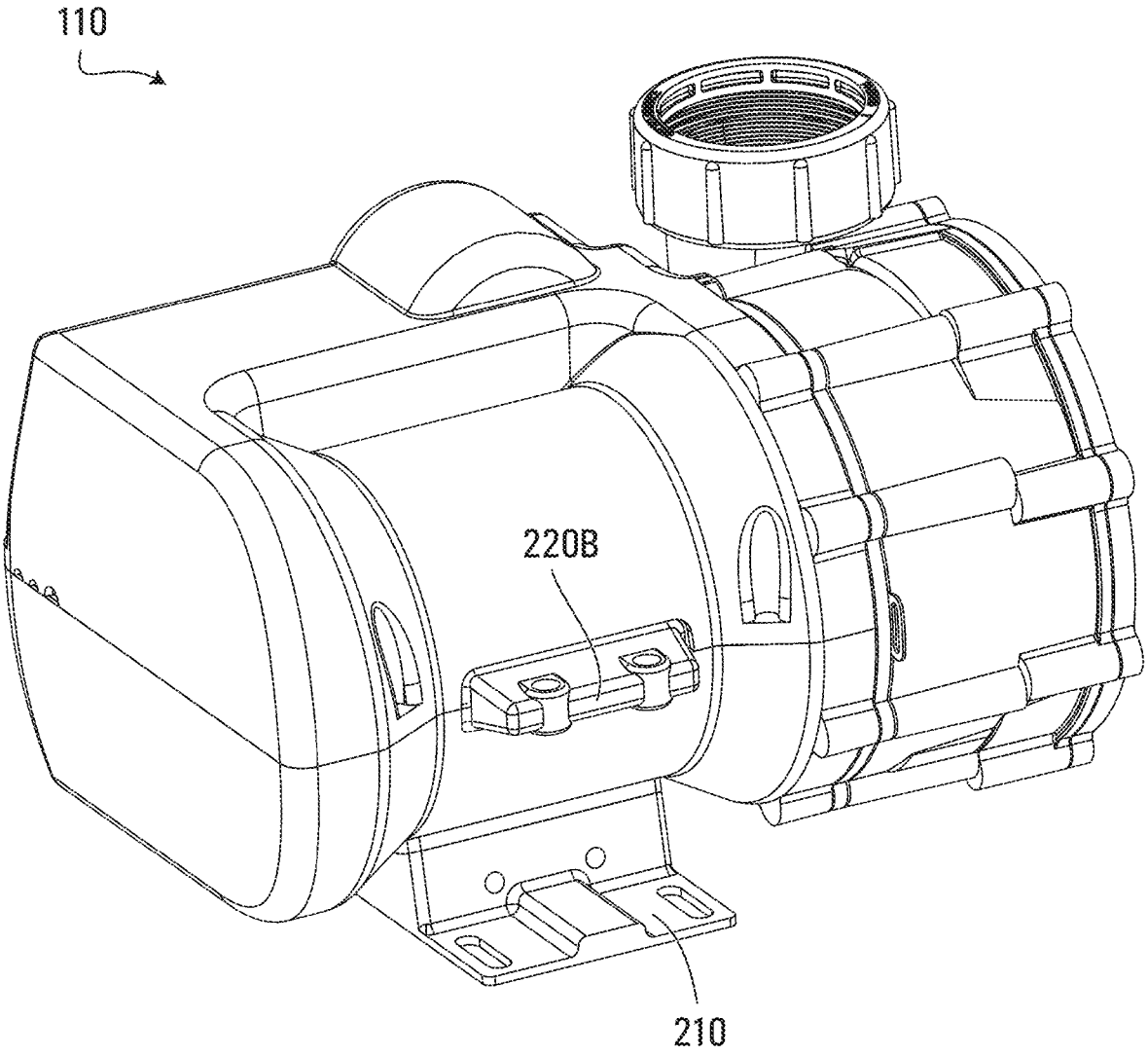
FIG. 12 shows a rear isometric view of the pump assembly of FIG. 2 with two pump mounting brackets positioned at different radial orientations about the surface of the casing of the pump assembly.

FIG. 12 shows a rear isometric view of the pump assembly 110 of FIG. 2 and FIG. 13 shows a similar view of the pump assembly 110 with the external casing 112 removed. Visible in FIG. 12 is a surface mounting bracket 210 and a pump mounting bracket 220B.

Figure 13A:
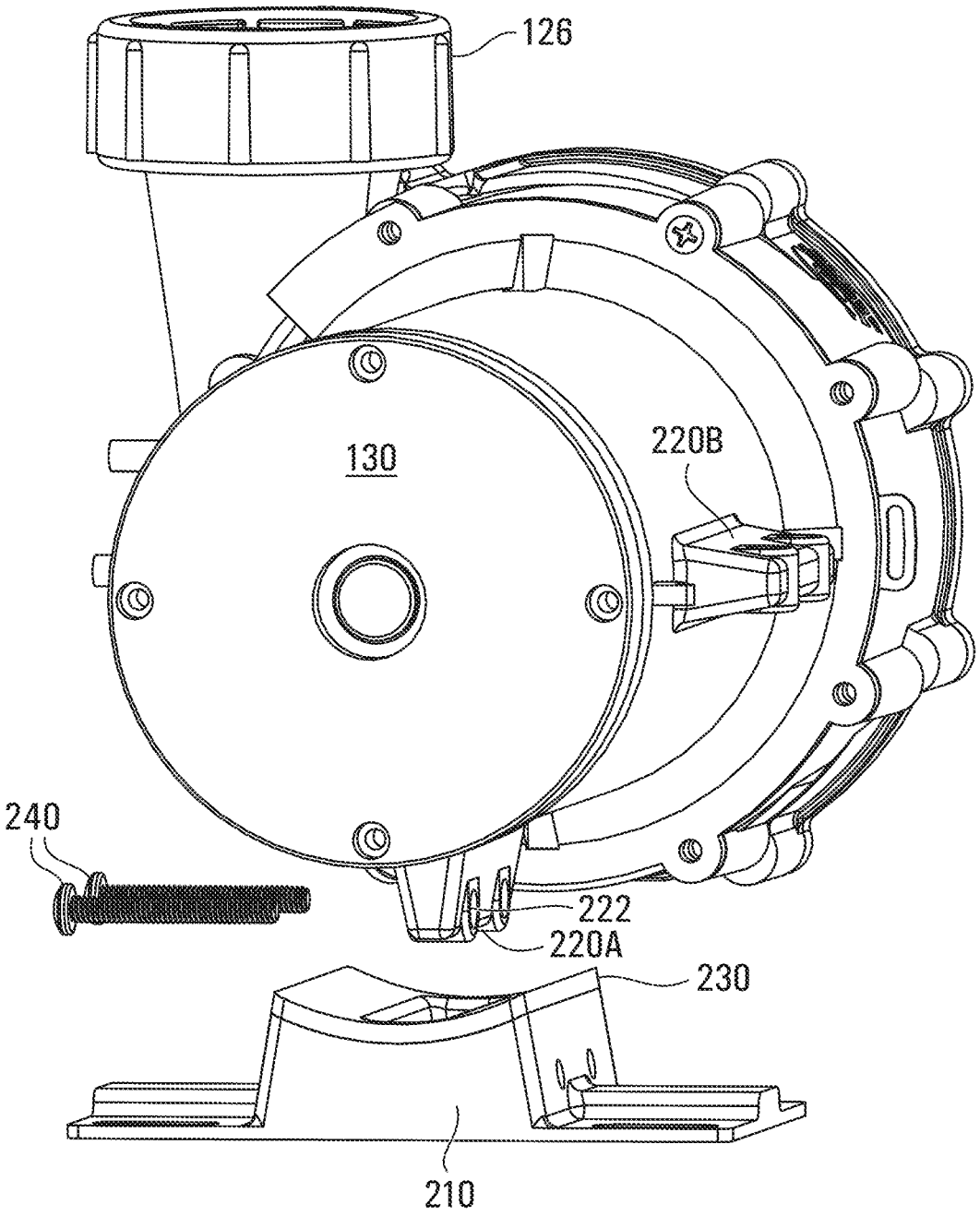
FIGS. 13A and 13B show perspective rear views of the of the pump assembly of FIG. 2 with the external casing removed, wherein the perspective rear views show the pump assembly in two different radial orientations.
Figure 13B:
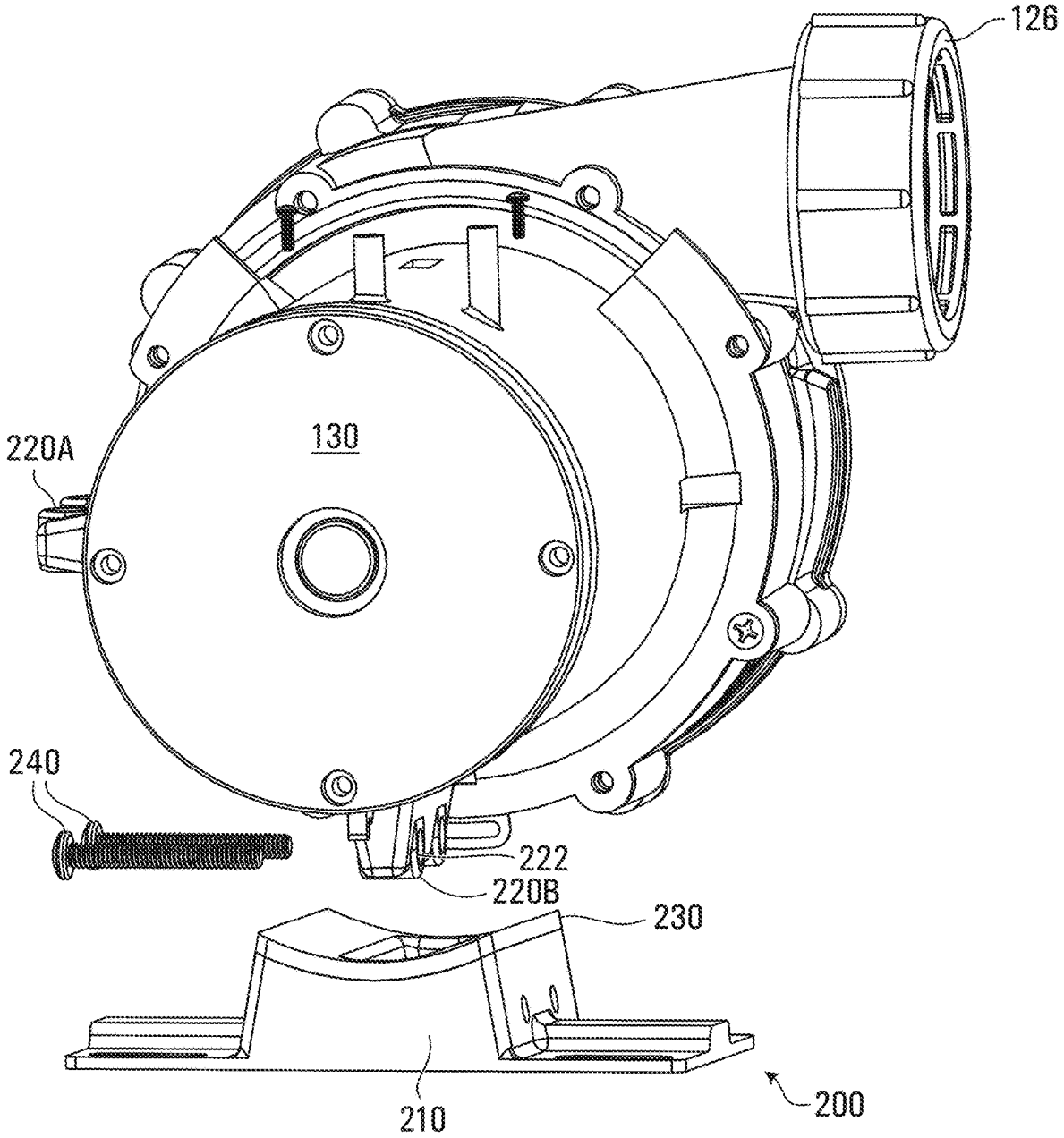

Referring to FIGS. 13A and 13B, in the embodiment shown, the pump assembly 110 includes two pump mounting brackets 220A, 220B. The two pump mounting brackets 220A, 220B are positioned at different angles along the circumference of the motor housing 130 and are configured for mounting the pump assembly 110 to the bathing unit system at a desired location and orientation. That is, the pump assembly 110 is mounted to a desired supporting structure, for example to a structure underneath the spa skirt, so that the water outlet port 126 is directed differently, e.g., so that water exits from the water outlet port 126 upwards in FIG. 13A and to the right in FIG. 13B. Each of the pump mounting brackets 220A, 220B is positioned at a different radial location on the motor housing 130 (and protrudes through the external casing 112 at a different radial location), the first radial location of the first pump mounting bracket 220A being distinct from the second radial location of the second pump mounting brackets 220B. This arrangement permits the pump assembly 110 to be fastened to the surface mounting bracket 210 at two different angles corresponding to the first radial location and second radial location.

Although two pump mounting brackets 220A, 220B are shown at 90 degrees from each other, differing numbers of mount portions positioned at different radial locations along the motor housing 130 are also possible in alternative implementations in order to provide varying levels of flexibility in the orientation of the water outlet port 126. For example, three pump mounting brackets can be positioned at 90 degrees from each other or pump mounting brackets can be positioned at 45 degrees from each other. Alternatively, the pump mounting brackets can be unevenly spaced and may be positioned at varying angles, e.g., pump mounting brackets can be positioned at 90 degrees and a third pump mounting bracket can be positioned at 45 degrees, at 30 degrees or at any suitable radial location about the circumference of the motor housing 130. Four or more pump mounting brackets are also possible.

Figure 14:
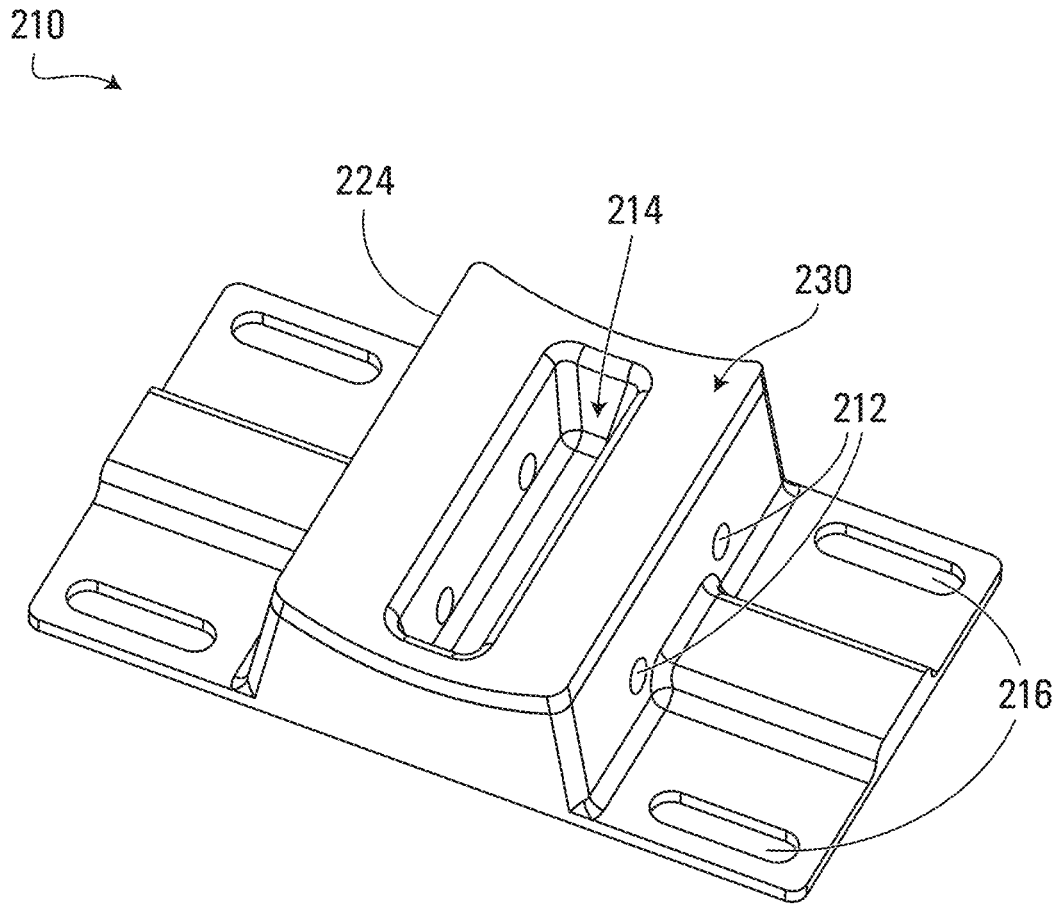
FIG. 14 shows a surface mounting bracket configured for receiving the pump mounting brackets depicted in the pump assembly shown in FIGS. 12, 13A and 13B.

Each pump mounting bracket 220 extends from the motor housing lateral surface 134 through the external casing 112 and is configured to mate with the surface mounting bracket 210. Referring as well to FIG. 14, the pump mounting bracket 220 engages with a slot 214 of the surface mounting bracket 210. When so fitted, screw holes 222 in the body of the pump mounting bracket 220 align with screw holes 212 of the wall mount portion, and mechanical fasteners 240 affix the portions of the mounting bracket together. The mechanical fasteners 240 can be screws or any other suitable fasteners. Wall fastener slots 216 permit the pump assembly 110 to be attached to a supporting structure at the desired orientation, such as to a wall or to a wooden frame in the spa.

As seen in FIGS. 13A and 13B, the mechanical fasteners 240 are oriented so that they connect the surface mounting bracket 210 and pump mounting bracket 220 at an angle orthogonal to the circumference of the motor housing 130. That is, the mechanical fasteners 240 are not oriented normal to or "into" the supporting structure (as fasteners fastened in slots 216 would be), but rather along an axis that extend longitudinally along at least part of the supporting structure. This orientation of the mechanical fasteners 240 beneficially reduces transmission of vibrations from the pump assembly 110 to the supporting structure to which is mounted the pump assembly 110 and may therefore reduce vibrations that would be felt by a user using the bathing unit system 10 (shown in FIG. 1).

In the embodiment shown in FIG. 14, a rubber pad 230 is affixed to the surface mounting bracket 210. The rubber pad 230 covers a generally arcuate top surface 224 of the mounting bracket 210 and, optionally, at least a part of the surface within the slot 214. The rubber pad 230 thus separates the surface mounting bracket 210 from the pump mounting bracket 220 when the two are joined. This separation aids in vibrational insulation of the pump assembly 110, as the rubber pad 230 functions to absorb vibrations generated by the motor. Additionally, the rubber pad 230 aids the installer of the pump assembly, allowing some freedom of movement when mounting the pump assembly 110. In some embodiments, the rubber pad 230 is made of rubber.

In addition, although the embodiments discussed make use of a generally cylindrical outer surface for the motor body and corresponding circulate shape for the arcuate member of the mounting bracket, other suitable surfaces shapes, such as for example but without being limited to octagonal or pentagonal shapes may be used in alternate embodiments. In such embodiments, the rotation of the mounting bracket about the circumference of the motor body may require that the mounting bracket be disengaged from the motor body, rotated and then re-engaged at the desired angle.

Certain additional elements that may be needed for operation of some embodiments have not been described or illustrated as they are assumed to be within the purview of those of ordinary skill in the art. Moreover, certain embodiments may be free of, may lack and/or may function without certain elements disclosed herein.

All references cited throughout the specification are hereby incorporated by reference in their entirety for all purposes.

It will be understood by those of skill in the art that throughout the present specification, the term "a" used before a term encompasses embodiments containing one or more to what the term refers. It will also be understood by those of skill in the art that throughout the present specification, the term "comprising", which is synonymous with "including," "containing," or "characterized by," is inclusive or open-ended and does not exclude additional, un-recited elements or method steps.

Unless otherwise defined, all technical and scientific terms used herein have the same meaning as commonly understood by one of ordinary skill in the art to which this invention pertains. In the case of conflict, the present document, including definitions will control. As used in the present disclosure, the terms "around", "about" or "approximately" shall generally mean within the error margin generally accepted in the art. Hence, numerical quantities given herein generally include such error margin such that the terms "around", "about" or "approximately" can be inferred if not expressly stated.

Although the present invention has been described in considerable detail with reference to certain embodiments thereof, variations and refinements are possible and will become apparent to the person skilled in the art in view of the present description. The invention is defined more particularly by the attached claims.

What is claimed is:

1. A pump assembly for a bathing unit system, the pump assembly comprising:

a. a motor housing holding an electric motor, the motor housing having a front end, a back end and a rotor shaft extending through the front end;

b. a wet-end housing having a water inlet port and a water outlet port in fluid communication with the water inlet port for circulating water through the wet-end housing in response to rotation of the rotor shaft;

c. a controller module including a circuit board including a controller for controlling operation of the electric motor;

d. a heat transfer interface positioned between the front end of the motor housing and the wet-end housing; and e. a rim positioned proximate the front end of the motor housing and engaged with the heat transfer interface, the rim comprising a first partial rim member and a second partial rim member at least partially thermally insulated from the first partial rim member to at least partially thermally insulate the controller module from the motor housing, wherein:

(i) the first partial rim member extends about a periphery of the front end of the motor housing except for a portion of the periphery of the front end and wherein the first partial rim member cooperates with the heat transfer interface to establish a first thermal conduction path between the motor housing and the wet-end housing so that, in use, a portion of heat generated by the electric motor is absorbed by the heat transfer interface and is dissipated in water circulating through the wet-end housing, and (ii) the second partial rim member fits in the portion of the periphery of the front end about the periphery of the front end of the motor housing and wherein the second partial rim member cooperates with the heat transfer interface to establish a second thermal conduction path between the controller module and the wet-end housing, so that, in use, a portion of heat generated by the controller module is absorbed by the heat transfer interface and is dissipated in the water circulating through the wet-end housing.

2. The pump assembly of claim 1, wherein the heat transfer interface includes:

a. a first surface engaged with the rim positioned about the front end of the motor housing; and b. a second surface opposed to the first surface, wherein when the pump assembly is in use, at least a portion of the second surface is exposed to the water circulating through the wet-end housing.

3. The pump assembly of claim 2, wherein a thermal interface material fills at least some voids between the first surface of the heat transfer interface and the rim, wherein the thermal interface material has a higher thermal conductivity than air.

4. The pump assembly of claim 3, wherein the thermal interface material includes a thermal gap filler material, comprising at least one of a thermal paste or a thermal pad.

5. The pump assembly of claim 1, wherein the heat transfer interface is engaged to the rim at least in part via a process including at least one of an induction heat shrinking process, a welding process or a brazing process.

6. The pump assembly of claim 1, wherein the motor housing is made of a material comprised at least in part of aluminum.

7. The pump assembly of claim 1, wherein the heat transfer interface is made of at least one of a thermally conductive material or a material generally resistant to corrosion.

8. The pump assembly of claim 7, wherein the thermally conductive material includes at least one of aluminum or copper.

9. The pump assembly of claim 7, wherein the material generally resistant to corrosion is comprised at least in part of at least one of titanium or stainless steel.

10. The pump assembly of claim 1, wherein the second partial rim member is further at least partially insulated from the motor housing to further at least partially insulate the controller module from the motor housing.

11. The pump assembly of claim 10, wherein a thermal insulation layer is located between the second partial rim member and the motor housing.

12. The pump assembly of claim 11, wherein the thermal insulation layer includes at least one of:

a. one or more air gaps between the second partial rim member and the motor housing, and b. a thermal insulating material between the second partial rim member and the motor housing.

13. The pump assembly of claim 1, wherein the first partial rim member is formed as a unitary portion of the motor housing and the second partial rim member is formed as a separate piece from the motor housing.

14. The pump assembly of claim 1, wherein, when the second partial rim member is fitted in the portion of the periphery of the front end, there is:

a. a first air gap between the second partial rim member and the first partial rim member proximate a first end of the are portion of the periphery of the front end; and b. a second air gap between the second partial rim member and the first partial rim member proximate a second end of the portion of the periphery of the front end.

15. The pump assembly of claim 1, wherein the second partial rim member includes a heat sink portion, the heat sink portion being configured to establish a thermal coupling with the controller module.

16. The pump assembly of claim 15, wherein the heat sink portion comprises a controller-facing side configured to establish the thermal coupling with the controller module, and a motor-housing-facing side shaped to conform to an outer surface of the motor housing.

17. The pump assembly of claim 16, wherein the motor-housing-facing side is machined to create a thermal separation gap between the motor-housing-facing side and the outer surface of the motor housing, wherein the thermal separation gap includes at least one of a groove or a plurality of prongs.

18. The pump assembly of claim 1, further comprising at least one pump mounting bracket extending from an outer surface of the motor housing for fastening the pump assembly to a supporting structure of the bathing unit system.

19. The pump assembly of claim 1, further comprising:

a. a first pump mounting bracket extending from an outer surface of the motor housing for fastening the pump assembly to a surface mounting bracket, the first pump mounting bracket being positioned at a first radial location on the motor housing; and b. a second pump mounting bracket extending from the outer surface of the motor housing for fastening the pump assembly to the surface mounting bracket, the second pump mounting bracket being positioned at a second radial location on the motor housing, the first radial location being distinct from the second radial location thereby permitting the pump assembly to be fastened to the surface mounting bracket in two different orientations corresponding to the first radial location and second radial location.

20. The pump assembly of claim 19, wherein the surface mounting bracket is configured to be secured to a supporting structure of the bathing unit system, and wherein the first pump mounting bracket is configured to be fastened to the surface mounting bracket using one or more mechanical fasteners such that the one or more mechanical fasteners engage the first pump mounting bracket and the surface mounting bracket along an axis that extends longitudinally along at least part of a surface of the supporting structure.

21. A method of transferring heat generated by an electric motor housed within a motor housing of a pump assembly and heat generated by a controller module for controlling operation of the electric motor of the pump assembly to a wet-end housing of the pump assembly, wherein the wet-end housing has a water inlet port and a water outlet port in fluid communication with the water inlet port for circulating water through the wet-end housing, the method comprising:

a. transferring the heat generated by the electric motor to a first partial rim member of a rim positioned proximate a front end of the motor housing and engaged with a heat transfer interface positioned between the front end of the motor housing and the wet-end housing, wherein the first partial rim member extends about a periphery of the front end of the motor housing except for a portion of the periphery of the front end, wherein the first partial rim member cooperates with the heat transfer interface to establish a first thermal conduction path between the motor housing and the wet-end housing so that, in use, a portion of the heat generated by the electric motor is absorbed by the heat transfer interface and is dissipated in water circulating through the wet-end housing; and b. transferring the heat generated by the controller module to a second partial rim member of the rim, wherein:

(i) the second partial rim member fits in the portion of the periphery of the front end about the periphery of the front end of the motor housing and wherein the second partial rim member is at least partially thermally insulated from the first partial rim member to at least partially thermally insulate the controller module from the motor housing; and (ii) the second partial rim member cooperates with the heat transfer interface to establish a second thermal conduction path between the controller module and the wet-end housing, so that, in use, a portion of the heat generated by the controller module is absorbed by the heat transfer interface and is dissipated in the water circulating through the wet-end housing.

22. A pump assembly for a bathing unit system, the pump assembly comprising:

a. a motor housing holding an electric motor, the motor housing having a front end, a back end, an outer lateral surface extending between the front end and the back end and a rotor shaft extending through the front end;

b. a wet-end housing having a water inlet port and a water outlet port in fluid communication with the water inlet port for circulating water through the wet-end housing in response to rotation of the rotor shaft, the water inlet port and the water outlet port configured to connect to circulation piping of the bathing unit system;

c. a controller module for controlling operation of the electric motor, the controller module positioned upon the outer lateral surface of the motor housing, wherein a thermal insulation layer at least partially separates the outer lateral surface of the motor housing from the controller module to reduce an amount of heat transfer between the controller module and the motor housing;

d. a heat transfer interface positioned between the front end of the motor housing and the wet-end housing, wherein the heat transfer interface is configured for:

i. establishing a first thermal conduction path between the motor housing and the wet-end housing so that, in use, a portion of heat generated by the motor is absorbed by the heat transfer interface and is dissipated in water circulating through the wet-end housing, and ii. establishing a second thermal conduction path between the controller module and the wet-end housing so that, in use, a portion of heat generated by the controller module is transferred to the heat transfer interface and dissipated in the water circulating through the wet-end housing; and e. at least one pump mounting bracket extending from the outer lateral surface of the motor housing for fastening the pump assembly to a supporting structure of the bathing unit system;

wherein the motor housing comprises a flange member forming a rim about the front end of the motor housing, the heat transfer interface being configured to engage the flange member; and wherein the rim includes a first partial rim member and a second partial rim member distinct from the first partial rim member, wherein:

i. the first partial rim member cooperates with the heat transfer interface to establish the first thermal conduction path between the motor housing and the wet-end housing; and ii. the second partial rim member cooperates with the heat transfer interface to establish the second thermal conduction path between the controller module and the wet-end housing, said second partial rim member at least partially thermally insulating the controller module from the motor housing.

23. The pump assembly of claim 22, wherein said heat transfer interface is engaged with the front end of the motor housing to establish the first thermal conduction path between the motor housing and the wet-end housing.

24. The pump assembly of claim 22, wherein the heat transfer interface includes:

a. a first surface engaged with the front end of the motor housing; and b. a second surface opposed to the first surface, wherein when the pump assembly is in use, at least a portion of the second surface is exposed to the water circulating through the wet-end housing.

25. The pump assembly of claim 24, wherein a thermal interface material fills at least some voids between the first surface of the heat transfer interface and the front end of the motor housing, wherein the thermal interface material comprises a material having a higher thermal conductivity than air.

26. The pump assembly of claim 25, wherein the thermal interface material includes a thermal gap filler material comprising at least one of a thermal paste or a thermal pad.

27. The pump assembly of claim 22, wherein the heat transfer interface is coupled to the front end of the motor housing:

a. at least in part via a process including at least one of an induction heat shrinking process, a welding process and a brazing process; and/or b. at least in part using at least one of an adhesive or one or more mechanical fasteners.

28. The pump assembly of claim 22, wherein the motor housing is made of a material comprised at least in part of aluminum and wherein the heat transfer interface is made of a thermally conductive material.

29. The pump assembly of claim 22, wherein the thermal insulation layer comprises one or more air gaps between the controller module and the motor housing and/or a thermal insulating material between the controller module and the motor housing.

30. The pump assembly of claim 22, wherein the thermal insulation layer separates said second partial rim member from the outer lateral surface of the motor housing to reduce the amount of heat transfer between the controller module and the motor housing.

31. The pump assembly of claim 22, wherein the at least one pump mounting bracket is configured to be fastened to the supporting structure using one or more mechanical fasteners such that, when the pump assembly is fastened to the supporting structure, the one or more mechanical fasteners engage the at least one pump mounting bracket along an axis that extends longitudinally along at least part of a surface of the supporting structure.

32. The pump assembly of claim 22, wherein the at least one pump mounting bracket comprises:

a. a first pump mounting bracket extending from the outer lateral surface of the motor housing for fastening the pump assembly to a surface mounting bracket, the first pump mounting bracket being positioned at a first radial location on the outer lateral surface of the motor housing, wherein the first pump mounting bracket is configured to be fastened to the surface mounting bracket using one or more mechanical fasteners such that, when the surface mounting bracket is secured to the supporting structure, the one or more mechanical fasteners engage the first pump mounting bracket and the surface mounting bracket along an axis that extends longitudinally along at least part of a surface of the supporting structure; and b. a second pump mounting bracket extending from the outer lateral surface of the motor housing for fastening the pump assembly to the surface mounting bracket, the second pump mounting bracket being positioned at a second radial location on the outer lateral surface of the motor housing, the first radial location being distinct from the second radial location there by permitting the pump assembly to be fastened to the surface mounting bracket in two different orientations corresponding to the first radial location and the second radial location.

* * * * *